US011105043B2

(12) United States Patent
Forester et al.

(10) Patent No.: US 11,105,043 B2
(45) Date of Patent: Aug. 31, 2021

(54) DECKLE BOARD SYSTEM WITH A SLOTLESS DECKLE SEAL STRIP

(71) Applicant: IBS of AMERICA, Chesapeake, VA (US)

(72) Inventors: Andrew Forester, Schoolcraft, MI (US); Joshua N. Kruger, Virginia Beach, VA (US)

(73) Assignee: IBS of America, Chesapeake, VA (US)

( * ) Notice: Subject to any disclaimer, the term of this patent is extended or adjusted under 35 U.S.C. 154(b) by 172 days.

(21) Appl. No.: 16/422,108

(22) Filed: May 24, 2019

(65) Prior Publication Data

US 2019/0368126 A1 Dec. 5, 2019

Related U.S. Application Data

(60) Provisional application No. 62/677,713, filed on May 30, 2018.

(51) Int. Cl.
*D21F 1/56* (2006.01)

(52) U.S. Cl.
CPC ..... *D21F 1/56* (2013.01)

(58) Field of Classification Search
CPC ..... D21F 1/56; D21F 1/58
USPC ..... 162/195, 310, 334, 353
See application file for complete search history.

(56) References Cited

U.S. PATENT DOCUMENTS 1,712,632 A 5/1929 Peterson et al.
2,305,300 A 12/1942 Lowe
2,735,343 A * 2/1956 Willemain ..... D21F 1/00 162/345
3,017,390 A 1/1962 Dunhap
3,323,982 A 6/1967 Hill
3,405,031 A 10/1968 Sisson
3,520,775 A 7/1970 Truxa
3,535,201 A 10/1970 Reynolds et al.
3,607,624 A * 9/1971 Moody ..... D21F 1/32 162/272
3,647,620 A 3/1972 Truxa
4,081,321 A 3/1978 Wolf et al.
4,124,441 A * 11/1978 Nykopp ..... D21F 9/003 162/301
4,184,915 A 1/1980 Metcalf
4,416,731 A 11/1983 Pesonen et al.
4,559,105 A 12/1985 Sennett et al.
(Continued)

FOREIGN PATENT DOCUMENTS

DE 102008059681 A1 6/2009
EP 2907918 A1 8/2015

OTHER PUBLICATIONS

Peterson, R. S., "Improving Basis Weight Uniformity with Deckle Wave Control", Tappi Journal, Technical Association of the Pulp & Paper Industry, Atlanta, US, vol. 75, No. 7, Jul. 1992, pp. 121-128.
(Continued)

*Primary Examiner* — Eric Hug
(74) *Attorney, Agent, or Firm* — Young Basile Hanlon & MacFarlane, P.C.

(57) ABSTRACT

A system comprising: one or more deckle board systems, each of the deckle board systems including: (a) one or more deckle board clamps; (b) a plurality of seal strip clamps; and (c) one or more seal strips; wherein each of the seal strips include one connection slot or less.

20 Claims, 11 Drawing Sheets

(56) References Cited

U.S. PATENT DOCUMENTS

| | | | | |
|---|---|---|---|---|
| 4,738,751 | A | 4/1988 | Newcombe | |
| 4,968,387 | A | 11/1990 | Beran et al. | |
| 5,045,154 | A | 9/1991 | Baluha | |
| 5,169,500 | A | 12/1992 | Mejdell | |
| 5,269,884 | A | 12/1993 | Peterson | |
| 5,284,551 | A * | 2/1994 | Beran | D21F 1/56 15/256.5 |
| 5,298,127 | A | 3/1994 | Beran | |
| 5,302,250 | A | 4/1994 | Peterson et al. | |
| 5,735,330 | A | 4/1998 | Buchmann et al. | |
| 6,146,502 | A | 11/2000 | Marx | |
| 6,470,598 | B2 | 10/2002 | Ringer | |
| 6,478,928 | B1 | 11/2002 | Sbaschnigg et al. | |
| 6,702,925 | B2 | 3/2004 | Bricco et al. | |
| 7,169,262 | B2 | 1/2007 | Bricco et al. | |
| 8,236,139 | B1 | 8/2012 | Reed | |
| 8,685,209 | B2 | 4/2014 | Faufau et al. | |
| 9,045,859 | B2 | 6/2015 | Gauss et al. | |
| 9,512,565 | B2 | 12/2016 | Forester et al. | |
| 9,822,483 | B2 | 11/2017 | Faufau et al. | |
| 9,822,484 | B2 * | 11/2017 | Forester | D21F 1/56 |
| 2002/0066549 | A1 | 6/2002 | Forester | |
| 2012/0267065 | A1 | 10/2012 | Faufau et al. | |
| 2014/0034261 | A1 | 2/2014 | Faufau et al. | |
| 2014/0202648 | A1 | 7/2014 | Faufau et al. | |
| 2014/0216675 | A1 | 8/2014 | Gauss et al. | |
| 2014/0216676 | A1 | 8/2014 | Gauss et al. | |
| 2015/0225897 | A1 * | 8/2015 | Forester | D21F 1/56 162/310 |
| 2016/0225897 | A1 | 8/2016 | Sridhar | |
| 2018/0087217 | A1 | 3/2018 | Forester et al. | |

OTHER PUBLICATIONS

Potentially Related U.S. Appl. No. 15/354,179, filed Nov. 17, 2016, U.S. Pat. No. 9,822,484, on Nov. 21, 2017.

Potentially Related U.S. Appl. No. 15/155,252, filed May 16, 2016, U.S. Pat. No. 9,822,483, on Nov. 21, 2017.

* cited by examiner

DECKLE BOARD SYSTEM WITH A SLOTLESS DECKLE SEAL STRIP

FIELD

The present teachings relate to an improved deckle board system and particularly an improved deckle board system including a deckle seal strip that includes one slot and preferably no slots for connecting the seal strip within a deckle board.

BACKGROUND

Typically, fourdrinier paper machines include a wet end with a wire that moves in a machine direction. The wire has a width and stock is applied substantially along the entire width of the wire. A deckle may be used on both edges of the wire to retain substantially all of the stock on the wire. Deckle boards are used to create an edge on a paper machine and to retain stock, water, fines, filler, or a combination thereof on the wire of the paper machine. Some paper machines include a static board that sits on an edge of the wire and prevents stock from exiting the wire from the cross machine direction. Other systems use water to cut the stock and/or slightly dried stock to form an edge on the wire. However, removing stock from the edges decreasing the width of the paper machine resulting in less tons per hour being run. Further, pushing the stock along the cross machine direction may result in an uneven formation along the edges and even towards the center of the sheet so that the sheet includes inconsistencies, which may lead to edges and/or paper being rejected. The deckle boards typically include one or more seal strips that are in contact with the wire or proximate to the wire to retain stock on the wire. Over time the seal strips wear out and need to be replaced. Generally, a plurality of fasteners (e.g., 10 or more, 20 or more, or even 30 or more) extend through the seal strip to help retain the seal strip in place. In order to change the seal strip, all of the fasteners need to be removed and then subsequently replaced, which can be very labor intensive resulting in additional down time.

Examples of devices for deckling edges of paper are disclosed in U.S. Pat. Nos. 1,712,632; 2,305,300; 3,607,624; 4,738,751; 4,968,387; and 9,822,483 and U.S. Patent Application Publication No. 2018/0087217 all of which are expressly incorporated herein by reference for all purposes. Thus, there is a need for a seal strip that is connected within a deckle board with one or more fasteners and preferably no fasteners. What is needed is a seal strip that is slotless. What is needed are one or more seal strip clamps that are substantially rigid so that the seal strip clamps are free of flexing when connected to a seal strip. What is needed is one or more connection adapters that anchor at least one location of the seal strip and prevent the seal strip from being moved in the machine direction. What is needed is a connection adapter that is self-tapping and penetrates the seal strip to form a connection with the seal strip.

SUMMARY

The present teachings provide a system comprising: one or more deckle board systems, each of the deckle board systems including: (a) one or more deckle board clamps; (b) a plurality of seal strip clamps; and (c) one or more seal strips; wherein each of the seal strips include one connection slot or less.

The present teachings provide a method comprising: inserting a seal strip between a deckle board clamp and a seal strip clamp; attaching the seal strip with an attachment connector so that the seal strip is prevented from moving in a machine direction.

The present teachings provide a method comprising: inserting a seal strip between a deckle board clamp and a seal strip clamp; rotating an attachment connector; and contacting the seal strip with the attachment connector.

The present teachings provide a seal strip that is connected within a deckle board with one or more fasteners and preferably no fasteners. The present teachings provide a seal strip that is slotless. The present teachings provide one or more seal strip clamps that are substantially rigid so that the seal strip clamps are free of flexing when connected to a seal strip. The present teachings provide one or more connection adapters that anchor at least one location of the seal strip and prevent the seal strip from being moved in the machine direction. The present teachings provide a connection adapter that is self-tapping and penetrates the seal strip to form a connection with the seal strip.

DETAILED DESCRIPTION

Figure 1:
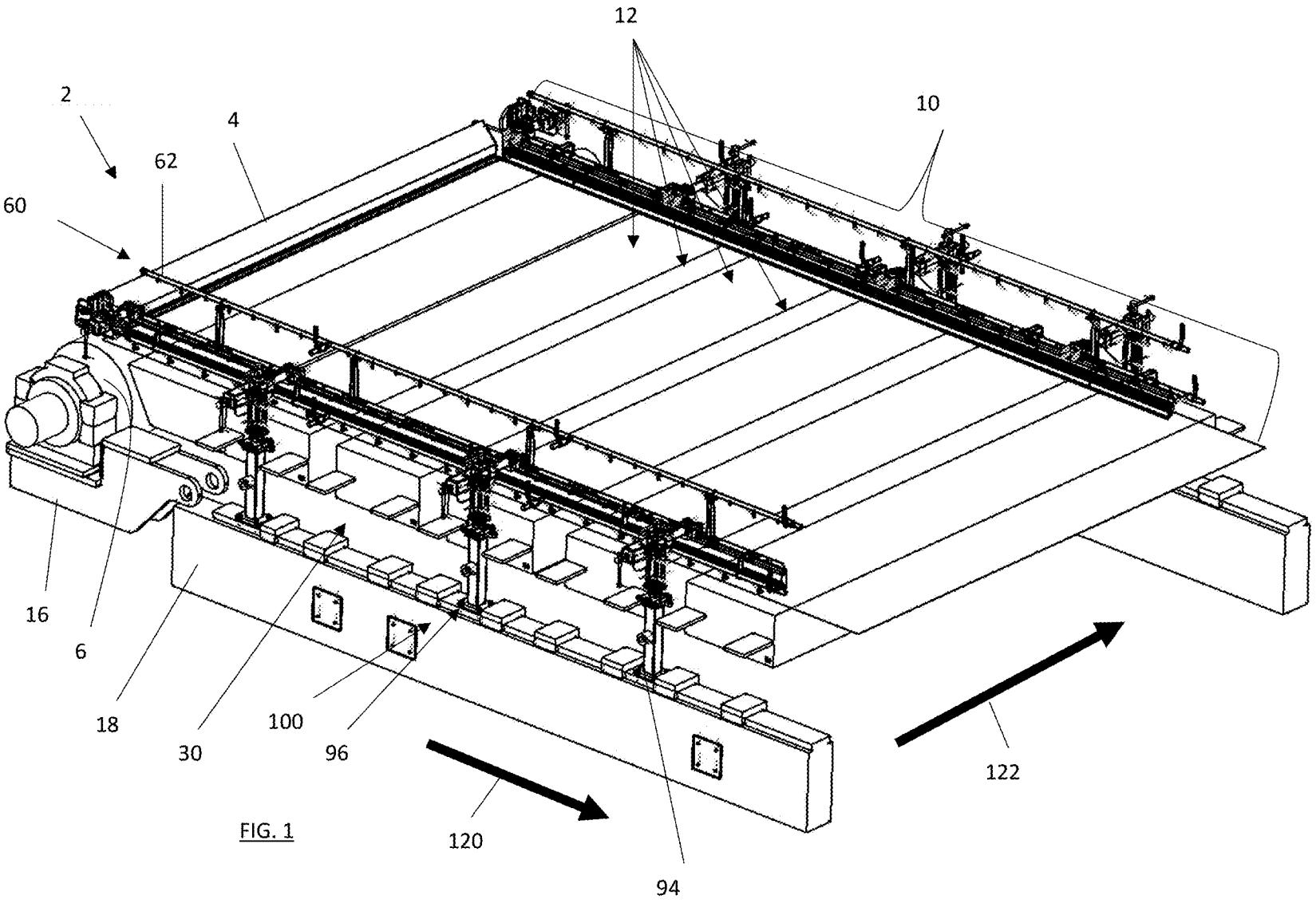
FIG. 1 illustrates a perspective view of a paper machine including a deckle system.

The explanations and illustrations presented herein are intended to acquaint others skilled in the art with the invention, its principles, and its practical application. Those skilled in the art may adapt and apply the invention in its numerous forms, as may be best suited to the requirements of a particular use. Accordingly, the specific embodiments of the present invention as set forth are not intended as being exhaustive or limiting of the teachings. The scope of the teachings should, therefore, be determined not with reference to the above description, but should instead be determined with reference to the appended claims, along with the full scope of equivalents to which such claims are entitled. The disclosures of all articles and references, including patent applications and publications, are incorporated by reference for all purposes. Other combinations are also possible as will be gleaned from the following claims, which are also hereby incorporated by reference into this written description.

The present teachings are predicated upon providing an improved deckle board system (i.e., deckle system) for a paper machine, and preferably a fourdrinier paper machine. The paper machine taught herein may be any paper machine that functions to create paper. The paper machine may be any style and/or type that forms paper with a deckled edge. The paper machine includes a head box that applies stock in a wet end. The head box may be gravity fed, pressurized, or both. The head box may function to apply stock to a wet end, above a breast roll, or both. The head box may function to apply stock to a forming board. The head box may apply stock proximate to a breast roll and a forming board.

The breast roll may be the first roll of the wet end (i.e., at the head box end), may assist in formation, may remove water from the stock, or a combination thereof. The breast roll may be the lead roll in a wet end. The wet end may function to receive stock and dewater stock. The wet end may have one or more and preferably a plurality of foil sections. The foil sections may each include one or more foils and preferably a plurality of foils. The foils may be height adjustable, angle adjustable, fixed, or a combination thereof. The foil sections may include one or more forming boards. A plurality of foil sections may be located adjacent to one another and adjacent to one another in a machine direction. The forming boards may be part of a forming board section. The forming board section may include height adjustable foils, angle adjustable foils, fixed foils, or a combination thereof. The wet end includes edges in a cross-machine direction. The wet end may have a wire that travels in a machine direction with stock and the stock is dewatered as the wire moves in the machine direction. Preferably, the wet end includes an endless wire that travels in a machine direction. The width of the wire may extend in the cross-machine direction. The wet end may have opposing edges that may have stock that runs along a cross-machine direction and falls off the wire. The wet end may end with a couch roll (i.e., couch roll end) that functions to wrap the wire and guide the wire in a direction opposite the machine direction so that an endless wire is formed. The couch roll may function to dewater. The couch roll may end the wet end. The couch roll may assist in guiding a sheet from the wet end into a press section.

The wet end may include a breast roll arm, a main frame, one or more end plates, one or more foil sections, one or more forming boards, one or more couch rolls, or a combination thereof. The main frame may be static and may connect the wet end of the paper machine to the ground. The main frame may function to support all of the other elements of the paper machine, the wet end, or both. The main frame may support a pair of opposing breast roll arms, a plurality of end plates, or both. The end plates may connect the foil sections within the paper machine, may form an edge of the wire, or both. The end plates may be connected to the breast roll arm, the main frame, or both. The breast roll may be vertically movable, rotationally movable, or both. The deckle system may be connected to the breast roll arm, the main frame, or both. The deckle system may be connected to the breast roll arm, the main frame, or both and prevent stock from traveling in the cross machine direction.

A deckle board system (or deckle system) may prevent stock from falling off the wire in the cross-machine direction. The deckle system may function to maintain a straight edge of stock on a wire. The deckle system may function to maintain a substantially constant caliper, basis weight, or both in the cross-machine direction of the paper machine. The deckle board system may include one or more deckle boards, one or more shower systems, or both for maintaining an edge of the stock, the paper, or both in a line, for creating a substantially constant basis weight, a constant caliper, a constant fiber orientation, a random fiber orientation, or a combination thereof in the cross-machine direction. Preferably, the deckle board system includes one or more deckle boards on each side of the wet end that extend substantially the length of the wet end (e.g., from the head box to the couch roll).

The one or more deckle boards have a stock side and a non-stock side. The one or more deckle boards may contact the stock so that as the wire passes along the deckle boards the stock sides maintains the stock on the wire. Preferably, the stock side of the deckle boards is free of contact with stock due to a boundary layer of shower water, a boundary layer of turbulence, or both. The one or more deckle boards may be substantially linear, substantially planar, or both along their length. Preferably, the deckle boards or portions of the deckle boards are free of warp and/or non-linear portions due to thermal expansion. The one or more deckle boards may be made of any material that is resistant to corrosion, abrasion, or both by stock. The one or more deckle boards may be made of and/or include metal, plastic, natural materials, synthetic materials, nylon, nylon 6, delrin, ceramic, polyurethane, low density polyethylene, polyethylene terephthalate, steel stainless steel, 308 stainless steel, 316 stainless steel, or a combination thereof. Preferably, the one or more deckle boards may be made of polyethylene (UHMW-PE). The one or more deckle boards may be made of a material that expands and/or contracts due to thermal expansion. Preferably, the material of the deckle boards is substantially free of thermal expansion. The one or more deckle boards may be free of contact with the wire, stock, or both. The one or more deckle boards may support a seal strip that may extend between the deckle board and the wire to retain stock on the wire. The one or more deckle boards may maintain the seal strip in a single plane, planar, linear, from curving, from warping, or a combination thereof. The one or more deckle boards may include one or more head box attachments that retain the deckle board substantially static and/or allow for thermal expansion in the machine direction as the deckle boards expand and contract.

The one or more head box attachments may function to locate the deckle board system, one or more shower systems, or both in the machine direction. The one or more head box attachments may prevent movement of the deckle board system in the machine direction. The one or more head box attachments may align the deckle board with the wet end so that the deckle boards create a deckle edge.

The deckle board may function to create one or more edges of paper on the paper machine. The deckle board may form an edge of the paper machine in the cross-machine direction. The deckle board may substantially retain all of the stock (i.e., fiber, water, filler, and/or chemicals) within the wet end of the paper machine. The deckle board may create a straight edge on one or both sides of the paper machine. One or more of the deckle boards may extend in the machine direction. One or more of the deckle boards may extend outward at an angle relative to the machine direction. The one or more deckle boards may extend outward as the deckle boards extend in the machine direction such that the cross-machine direction gradually increases in the machine direction. The deckle boards on opposing sides of the paper machine may extend away from each other (i.e., diverge). The deckle boards may be linear, curved, stepped, linear segments with changing slopes, or a combination thereof. For example, the two deckle boards may extend outward so that the two deckle boards form a "V" shape. In another example, the deckle boards may extend outward and form generally two back to back "J" shapes. The deckle boards may be pliable so that the deckle boards generally curve as the deckle boards extend in the machine direction. For example, the amount the deckle board curves outwards may increase as the deckle board extends in the machine direction, thus increasing the rate of change of the slope. Preferably, the deckle board curves in the machine direction as the deckle board extends away from the head box so that the deckle board has an exponential curve (i.e., the curve of the deckle board increases at a greater rate as the deckle board extends away from the head box). The deckle board may include one or more deckle board clamp, one or more seal clamps, a plurality of fasteners, one or more seal strips, one or more covers, one or more head box attachments, or a combination thereof. Preferably, the deckle board includes a deckle board clamp and a plurality of seal strip clamps that hold a seal strip in place and the deckle board clamp and the plurality of seal strip clamps are connected together by a plurality of fasteners. The deckle board clamp and the plurality of seal clamp may apply a force on the seal strip that retains the seal strip within the deckle board and prevents movement of the seal strip in the machine direction. The deckle board may include a connection adapter that assists in connecting the seal strip within the deckle board system. The deckle board may include a single fastener that retains the seal strip within the deckle board. The deckle board may be a single piece. The deckle board may be two or more pieces or even a plurality of pieces connected together by a connection joint.

The connection joint may function to permit two or more deckle boards to connect together, to thermally expand (e.g., lengthening), thermally contract (e.g., shortening); bend, pivot, be length adjustable, length changeable, have varying heights, varying thicknesses, or a combination thereof. The connection joint may connect two or more deckle board sections together. The connection joint may prevent the deckle board sections from being separated in the machine direction, cross machine direction, vertically (e.g., in plane), or a combination thereof. The connection joint may connect together by one or more tongue and grooves, one or more male pieces and female pieces, interconnected parts, or a combination thereof. The connection joint may form a connection without fasteners. The connection joint may be locked together with one or more fasteners. The connection joint may only be connected and disconnected in a single direction. For example, when the two deckle board sections are connected the deckle board sections may have a stop that prevent the deckle board sections from continuing to move in a first direction. The connection joint may extend from a first side to a second side of each deckle board section. The connection joint may be located (or visible) on one side when the deckle boar sections are connected together. The connection joint may only removable in a section direction where the seal strip clamp extends. The seal strip clamp may have a portion that extends across the connection joint. The seal strip clamp may have a portion on a first side of the connection joint and a portion on a second side of the connection joint. The connection joint may be spaces in the deckle board that allow a portion of the deckle board to thermally expand or thermally contract without the deckle board warping, curving, or both. The connection joint may allow two or more different deckle board parts to be connected together. The connection joint may allow deckle board sections of different lengths, heights, widths, thicknesses, or a combination thereof to be connected together. The connection joint may permit deckle board sections of different shapes to be connected together. For example, at a headbox end of the deckle board system the deckle board may have a first shape and subsequent deckle board sections may have a different size or shape. The deckle board sections may be connected together by one or more deckle board clamps, the connection joint themselves, or a combination of both.

The deckle board clamp may function as a gripping feature to retain a seal strip within the deckle board. The deckle board clamp may function to permit longitudinal movement of the seal strip relative to the deckle board due to thermal expansion or vice versa. The deckle board clamp may resist lateral movement of the seal strip (i.e., down towards the wire, forming section, and/or paper machine). The deckle board clamp may prevent longitudinal moving, warping, thermal expansion, movement, or a combination thereof of the seal strip. The deckle board clamp may be a portion of the deckle board on the non-stock side that forms one wall of a pinch point that retains the seal strip within the deckle board. The deckle board clamp may be integrally connected to a seal strip clamp. The deckle board clamp and seal strip clamp may be connected together one or more and preferably a plurality of fasteners. The deckle board clamp may include one or more connection recesses that connect the deckle board clamp within the deckle board system, to a seal strip clamp, or both.

The one or more connection recesses may function to receive one or more adjustment brackets, one or more connectors, one or more fasteners, or a combination thereof. The one or more connection recesses may function to fixedly connect the deckle board clamp to a frame, a stand assembly, or both. The one or more connection recesses may receive all or a portion of an adjustment bracket that connects the deckle board clamp to a lower bracket clamp and an upper bracket clamp. The one or more connection recesses may extend a length of the deckle board clamp. The one or more connection recesses may be a continuous recess that extends a length of a deckle board clamp. The one or more connection recesses may be located internal of the deckle board clamp so that a connector located therein is entirely located within the deckle board clamp. The connection recess may include a connector that assists in connecting the seal strip, seal strip clamp, or both to the deckle board clamp. The connection recesses may receive the connector and a fastener so that a seal strip may be locked between the seal strip clamp and the deckle board clamp.

The one or more seal strip clamps may function as a gripping feature to retain a seal strip within a deckle board. The one or more seal strip clamps may function to sandwich a seal strip between the deckle board clamp and the seal strip clamp. The seal strip clamp may function to permit longitudinal movement of the seal strip relative to the deckle board due to thermal expansion or vice versa. Preferably, the one or more seal strip clamps prevent movement in the machine direction, the cross-machine direction, or both. The seal strip clamps may resist lateral movement of the seal strip (i.e., down towards the wire, forming section, and/or paper machine). The seal strip clamps may be discrete pieces that are connected to the deckle board, the deckle board clamp, or both. Preferably, the deckle board system includes a plurality of seal strip clamps. The seal strip clamp may be one or more walls or plates that opposes the deckle board clamp and retains a seal strip within the deckle board. The seal strip clamp may be one or more solid pieces. Plurality, the seal strip clamps are a plurality of seal strip clamps. The plurality of seal strips clamps may be a plurality of adjacent plates that are located side by side, edge to edge, in a row, or a combination thereof. The plurality of adjacent plates may be square, rectangular, symmetrical, or a combination thereof. Each of the plurality of adjacent plates have a length and a width. The length may be greater than the width. The length may be about 1.1× the width or more, about 1.2× the width or more, about 1.3× the width or more, or about 1.× the width or more. The length may be sufficiently short so that when a force is applied to the deckle clamp, the seal strip clamp, or both the seal strip clamps retain their shape and prevent movement of the seal strip. The seal strip clamp may be free of bending or flexing, may support the deckle board clamp, or both. Each seal strip clamps may be connected to the deckle board clamp by one or more fasteners. Each of the seal strip clamps may have fastener located in a first edge region, a second edge region, or both. The fasteners may prevent the deckle board clamp from flexing, support the deckle board clamp with the seal strip clamps, hold the seal strip in place, prevent movement of the seal strip, or a combination thereof. Each of the seal strip clamps may have a length of about 25 cm or more, 50 cm or more, about 1 m or more, 1.5 m or more, about 2 m or more, or about 3 m or more. Each seal strip clamp may be about 7 m or less, about 5 m or less, or about 4 m or less. Each seal strip clamp may be sufficiently thick so that the seal strip clamps stay substantially planar when connected to a deckle board clamp, may maintain a seal strip planar, or both. Each seal strip clamp may have a thickness of about 2 mm or more, about 3 mm or more, about 5 mm or more, about 7 mm or more, about 1 cm or more, about 1.5 cm or more, or about 2 cm or more. Each seal strip clamp may have a thickness of about 7 cm or less, about 5 cm or less, or about 4 cm or less. The steel strip clamps may be made of a polymer, metal, plastic, or a combination thereof. Preferably, the seal strip clamps are made of aluminum, stainless steel, 316 stainless, 308 stainless, 403 stainless, 404 stainless, 405 stainless, 410 stainless, or a combination thereof. The seal strip clamp may be a hollow piece. The seal strip clamp may be a plurality of solid pieces. A seal strip clamp located proximate to the head box may include one or more seal strip clamp recesses. A first seal strip clamp may include a seal strip clamp recess, one or more fasteners, one or more expansion chambers, or a combination thereof.

The one or more seal strip clamp recesses may function to permit one or more connection adapters to connect to a seal strip, a deckle board clamp, a deckle board, or a combination thereof. The one or more seal strip clamp recesses may prevent movement of the connection adapter in the machine direction, toward the wire, away from the wire, or a combination thereof while the connection adapter retains the seal strip in place. The one or more seal strip recesses may be complementary in shape to the connection adapter. The one or more seal strip recesses may be a key hole that the connection adapter fits through. The one or more seal strip recesses may expose a portion of the seal strip, the deckle board clamp, fastener recess, fastener, or a combination thereof so that the connection adapter contacts the seal strip, a connection may be formed, or both. The one or more seal strip recesses may expose one or more fastener recesses within the deckle board, deckle board clamp, or both so that the connection adapter may be connected to the deckle board, the deckle board clamp, or both. Preferably, the seal strip clamp recesses expose both a portion of a seal strip and one or more fastener recesses. The one or more seal strip clamp recesses may be located proximate to an expansion chamber or between two expansion chambers.

The expansion chambers may function to allow movement of the deckle board, seal strip, seal strip connector, or a combination thereof relative to each other. The expansion chamber may be a space between all or a portion of one or more or preferably two or more seal strip clamps. The expansion chamber may allow a portion of a deckle board, deckle board clamp, seal strip clamp, or a combination thereof of to move, expand, contract, or a combination thereof. The expansion chamber may have a constant size along a width, length, or both. The expansion chamber have a first side that is stepped inward relative to a second side. The expansion chamber may be one or more steps, two or more steps, or three or more steps. The expansion chamber may be a space or gap between a first seal strip clamp and a second seal strip clamp. The expansion chamber may be a lack of material. The expansion chamber may be a region of reduced support due to a lock of material or an absence of material from the seal strip clamp. The expansion chamber may extend inward from an edge, may create an edge with a staggered shape, may create an edge that steps inward, an edge steps outward, or a combination thereof. The expansion chamber may when adjacent to another adjacent chamber may have a "Y" shape. The expansion chamber may be an inward step proximate to or above a fastener, a fastener recess, or both. An expansion chamber space proximate to or above a fastener, a fastener recess, or both may be larger than an expansion chamber space below the fastener, the fastener recess, or both. For example, a distance between two seal strip clamps may be greater at or above the fastener, fastener recess, or both than below the fastener, fastener recess, or both.

The one or more fastener recesses function to connect a seal strip clamp to a deckle board, or a deckle board clamp. The one or more fastener recesses function to receive one or more fasteners. The one or more fastener recesses may be threaded. The one or more fastener recesses may be a through hole. The one or more fastener recesses may be circular, oval, square, rectangular, geometric, symmetrical, or a combination thereof. The one or more fastener recesses may each receive one fastener. The one or more fastener recesses may be located proximate to a seal strip so that the fastener, the seal strip clamp, the deckle board clamp, or a combination thereof retain a seal strip in place. The one or more fasteners may be free of direct connection with a seal strip. The one or more fasteners may hold a connection adapter in place and the connection adapter may be in communication with the seal strip.

The seal strip may function to form a seal between the deckle board and the wire. The seal strip may be made of any material that may form a seal with the wire, the foils, or both. The seal strip may function to create a low surface energy material barrier. The seal strip may function to prevent stock build up, prevent laminar flow, or both. The seal strip may be compliant so that the seal strip moves with angle adjustable foil blades, height adjustable foil blades, or both and prevents stock from passing under the seal strip. The seal strip may move with the foils as the foils are adjusted so that stock is retained on the wire. The seal strip may be a low friction material. The seal strip may be made of polytetrafluoroethylene, coated with polytetrafluoroethylene, include polytetrafluoroethylene, or a combination thereof. The seal strip may include one connection slot or less. The plurality the seal strips may be free of connection slots.

The connection slots function to prevent the seal strip from being removed from the deckle board, moved in the machine direction, or both. The connection slot may allow for a fastener, a portion of a connection adapter, a portion of a connection member, or a combination thereof to extend through the seal strip. Preferably, the seal strip includes at least one connection slot for preventing movement of the seal strip in the machine direction; preventing the seal strip from being pulled by the wire, stock, or both. However, the seal strip may be free of connection slots. If a connection slot is present the slot located closest to the head box. The connection slots may be round, oval, a slit, a through hole, or a combination thereof. Preferably, the seal strip, when installed in the deckle board is free of any connection slots. The connection slots may be formed after installation of the seal strip between the deckle board clamp and the seal strip clamp. The connection slots may be formed by a portion of the connection adapter piercing into and/or through the seal strip. The connection slots may be formed by a fastener receptacle including a tip that pierces through or into the seal strip. The seal strip may include a plurality of expansion slots that are located adjacent to the connection slots and in a successive row. The seal strip may be held in place by one or more and preferably a plurality of fasteners extending between and connecting the deckle board clamp to the seal strip clamp.

The fasteners may function to connect the one or more seal strips within the deckle board, to the deckle board, or both. The one or more fasteners may extend through the seal strip, create pressure on the seal strip, or both. Preferably, only one fastener extends through the seal strip (i.e., a connection fastener). More preferably, no fasteners extend through the seal strip clamp. The connection fastener preferably is the first fastener, is located proximate to the head box, through the fastener receptacle, or a combination thereof although the connection fastener may be located downstream of the head box (e.g., in a second or third slot). The one or more and preferably a plurality of fasteners (i.e., pressure fasteners) may create pressure on the seal strip. Preferably, the fasteners are all pressure fasteners and are free of connection fasteners. The plurality of fasteners may be a plurality of pressure fasteners that create a clamping force on the seal strip to retain the seal strip proximate to the deckle board. The plurality of fasteners may connect the deckle board clamp and the seal strip clamp together. The plurality of fasteners may connect the deckle board to the head box. One or more of the fasteners may extend through one or more connection adapters.

The one or more connection adapters may function to prevent movement of the seal strip in the machine direction, towards the wire, into contact with a seal strip that is not aligned with a fastener, or a combination thereof. The one or more connection adapters may function to place a seal strip in indirect communication with a fastener. The one or more connection adapters may function to contact or connect to a seal strip without a fastener being in contact with the seal strip. The one or more connection adapters may extend into a seal strip slot, create a seal strip slot, or both. The connection adapter may extend through a seal strip clamp. The connection adapter may be located in a recess within a seal strip clamp. The one or more connection adapters may be one or more pieces. The one or more connection adapters may be "U" shaped, "C" shaped, "E" shaped, have one or more projections, have two or more projections, or a combination thereof. The connection adapter may have a body that extends between and connects the fastener receptacle and the connection member. The body portion may extend parallel to the deckle board clamp, seal strip clamp, deckle board, or a combination thereof. The body portion may extend coplanar with the seal strip, between the deckle board clamp and the seal strip clamp, or both. The one or more connection adapters may include one or more projections that extend into the deckle board, the deckle board clamp, through the seal strip clamp, through the seal strip clamp recess, into contact with a seal strip, or a combination thereof. The one or more connection adapters may include one or more through holes that a fastener may extend through. The one or more connection adapters may include one or more fastener receptacles, one or more connection members, or both. Preferably, the one or more connection adapters includes one or more fastener receptacles and one or more connection members. The one or more connection adapters may be in a locked position or moved to a retracted position or a rotated position.

The locked position may function to have the connection adapter hold the seal strip from being moved in the machine direction, downwardly, out of between the seal strip clamp and the deckle board clamp, or a combination thereof. In the locked position, the connection adapter may be in contact with, extended into, extended through, or a combination thereof the seal strip. In the locked position, a connection member of the connection adapter may be in contact with, extend through, form a slot, or a combination thereof in the seal strip or the connection slot of the seal strip. The connection adapter may be aligned with, all or a portion located within a seal strip clamp recess, or both in the locked position. The connection adapter in the locked position may pierce the seal strip to form a slot. The connection adapter may move axially along a fastener when the connection adapter is moved from a locked position to a retracted position.

The connection adapter in the retracted position may function to compress a bias member, release the seal strip, move out of a slot, or a combination thereof. The connection adapter may axially move along a fastener away from the seal strip to be in a retracted position. In the retracted position, a seal strip may be removed, added, or both. The retracted position may bias the connection adapter back to a locked position when a retraction force is released. The retracted position remain axially aligned with the seal strip clamp recess. Once the connection adapter is in the retracted position, the connection adapter may be rotated into the rotated position where the connection adapter may be locked in place so that a seal strip may be added, removed, fixed, moved, adjusted, or a combination thereof.

The rotated position may function to move the connection adapter to a position where the seal strip may be moved, added, removed, fixed, adjusted, or a combination thereof. The rotated position may be where the connection member is moved from alignment with the seal strip clamp recess to being located over the seal strip clamp. In the rotated position the connection adapter may not be moved into contact with the seal strip. In the rotated position the connection adapter may be released so that all or a portion of a bias force stored in the bias member may be released. The rotated position may be where a portion of the connection adapter is not aligned with the seal strip, seal strip clamp recess, or both. In the rotated position the connection member may be rotated towards or away from a fastener receptacle.

The one or more fastener receptacles may function to connect the connection adapter to the deckle board, deckle board clamp, seal strip clamp, seal strip, or a combination thereof. The one or more fastener receptacles may receive one or more fasteners. Each fastener receptacle may receive a fastener. The fastener receptacles may extend into the deckle board, the deckle board clamp, the seal strip clamp, or a combination thereof. The faster receptacles may be a through hole that receives a fastener. The one or more fastener receptacles may be parallel to the deckle board, deckle board clamp, seal strip clamp, or a combination hereof. The one or more fastener receptacles may have a portion (e.g., projection) that extends into the deckle board, the deckle board clamp, the seal strip clamp, or a combination thereof. The projection may have an outer shape. The one or more fastener receptacles may have an outer shape and an inner shape. The outer shape may be keyed or complementary to the deckle board, the deckle board clamp, the seal strip clamp, or a combination thereof. The outer shape may fit within a recess of the deckle board, the deckle board clamp, the seal strip clamp, or a combination thereof. A connection between the outer shape of the fastener receptacle and the recess may prevent rotation of the connection adapter. The outer shape fit within a recess so that a body portion extends parallel to the deckle board, deckle board clamp, seal strip clamp, or a combination thereof. The outer shape may be symmetrical, asymmetrical, square, rectangular, circular, oval, oblong, triangular, pentagonal, hexagonal, a geometric shape, or a combination thereof. The inner shape may be a recess that receives one or more fasteners so that the fastener extends through the fastener receptacles and connect with the deckle board, deckle board clamp, the seal strip clamp, or a combination thereof. The one or more fastener receptacles may assist in connecting the connection adapter to the deckle board, deckle board clamp, seal strip clamp, or a combination thereof. The one or more fastener receptacles may be located in a separate plane than a connection member, above a seal strip, or both. The fastener receptacle may be connected to a connection member by a body that extends between the fastener receptacle and the connection member.

The one or more connection members may function to form a connection with a seal strip, to hold a seal strip in place, the prevent a seal strip from moving in the machine direction, prevent a seal strip from being removed from between the seal strip clamp and the deckle board clamp. The one or more connection members may extend into a connection slot within a seal strip. The one or more connection members may have a complementary shape to the connection slot within the seal strip. The one or more connection members act similar to a fastener so that the connection member retains the seal strip in place. The one or more connection members may create a connection slot. The one or more connection members may be self-tapping. The one or more connection members may have a blunt tip, a pointed tip, a sharp tip, a blade, threaded, helically threaded, or a combination thereof. The tip may have a mushroom shape, may mushroom after extending though the seal strip, mushroom when in contact with the seal strip, have a cross-shape, have sharp edges, have a point, have a conical shape, a point, are sharpened, have a tip, have a partial diamond shape, are cone shaped, or a combination thereof. The one or more connection members may have a shape so that when the seal strip clamp and the deckle board clamp sandwich the seal strip the connection member is forced through the seal strip. The one or more connection members may be forced through the seal strip clamp as a fastener located within the fastener receptacle tightens the connection adapter. The one or more connection members may grip the seal strip. The one or more connection members may prevent movement of the seal strip. The one or more connection members may press into the seal strip without extending through the seal strip so that the seal strip is retained between the deckle board clamp and the seal strip clamp. The one or more connection members may elastically deform the seal strip, plastically deform the seal strip, or both. Each connection adapter may include one or more connection members. Each connection adapter may include a plurality of connection members. The one or more connection adapters may function to retain a seal strip within a deckle board system.

The deckle board system may include a head box attachment that attaches the deckle board system to a location proximate to the head box, to the head box, the breast roll arm, or a combination thereof. The head box attachment may be a single point of fixed attachment (i.e., is not movable). The head box attachment may create an anchor that prevents the deckle board system from moving in the machine direction, although the deckle board system may be extendable and/or expandable in the machine direction. The head box attachment may attach to one or more shower systems or may connect the deckle board and the one or more shower systems to the paper machine.

The one or more shower systems may function to clean the deckle board system. The one or more shower systems may function to prevent a buildup of stock on any deckle board components. The shower system may function to create a boundary layer. The shower system may function to prevent stock build-up on any parts of the deckle board system. The shower system may create a continuous waterfall of water on the stock side, non-stock side, or both of the deckle board. The shower system may cascade water over the top of the deckle board to clean the deckle board, create the boundary layer, or both. The shower system may provide water equally to the stock side and non-stock side of the deckle board. The shower system may provide water along the deckle board in the machine direction. For example, the shower system may spray water in the machine direction so that the water forms a fluid barrier between the stock and the deckle board. The shower system may spray water in the machine direction so that a velocity difference between the stock and the fluid boundary layer is minimized so that the fluid boundary layer prevents waves, disruptions, or both on the edges of the stock. The shower system may create a layer of water proximate to the deckle board, the seal strip, or both that any movement of fluid (e.g., waves) in the machine direction contact so that fluid is prevented from contacting the seal strip or the deckle board. The shower system may include one or more shower bars, one or more shower nozzles, or both that apply a spray to the deckle board. The one or more shower systems may be two or more, three or more, or even four or more sets of shower systems. The one or more shower systems may be an upper shower system, a lower shower system, an end shower system, a boundary layer shower system, or a combination thereof.

The upper shower system may function to create a constant waterfall of water across the deckle board, a curtain of water, or both on the one or both sides of the deckle board. The upper shower curtain may provide water on the top of the deckle board so that water flows on both sides. The upper shower curtain may gravity feed water to the top of the deckle board. The upper shower may provide spray, water, or both behind a boundary layer system. The water may be applied in such a manner that surface tension of the water applied may maintain the water proximate to the deckle board, the seal strip, or both. The upper shower system may be used alone or in conjunction with a lower shower system.

The lower shower system may be located entirely on the non-stock side of the deckle board. The lower shower system may function to direct fluid at the seal strip, under the seal strip, or both. The lower shower system may create turbulence at the seal strip, on the seal strip, or both. The lower shower system may provide a boundary layer of water at the seal strip, under the seal strip, in front of the seal strip, or a combination thereof. The lower shower system may prevent a seal from being formed between the seal strip and the wire, forming table, foils, or a combination thereof. The lower shower system may have a low angle trajectory. The lower shower system may be angled so that any waves on the wire, forming table, or both are negated by the spray of the lower shower system. The lower shower system may dampen any waves on the wire, forming table, or both. The upper shower system and the lower shower system may span all or a portion of the length of the wet end, the forming table, the wire, or a combination thereof. The upper shower system and the lower shower system may mirror each other. For example, the nozzles of the upper shower system may be longitudinally located at a same distance as the nozzles of the lower shower system. The nozzles of the upper shower system and the nozzles of the lower shower system may be staggered, aligned, or both. The upper shower system, lower shower system, or both may be used in conjunction with and/or replaced by one or more end showers.

The one or more end showers may function to provide water to the head box end of the deckle board, the breast roll end of the deckle board, or both. The one or more end showers may function to provide additional water to the ends of the deckle board. The one or more end showers may provide additional cleaning to the ends of the deckle boards. The one or more end showers may only be located at the head box end and may create turbulence at the beginning of the deckle board. The one or more end showers may spray directly on the face of the deckle board. The one or more end showers may include a shower bar that extends outward away from the deckle board and then curves back towards the deckle board. The end shower may be located above and/or adjacent to a boundary layer shower.

The boundary layer shower may function to form a boundary layer of fluid (herein after water, but the water may include paper machine chemicals, fines, be recycled paper machine water, or a combination thereof) between the stock and the face of the deckle board. The boundary layer shower may function to hydraulically form a deckled edge. The boundary layer shower may form current, eddies, turbulence, or a combination thereof along an edge of the deckle board so that a deckled edge is formed. The boundary layer shower may provide water at a sufficient velocity so that shear between the boundary layer water and the stock is minimized, reduced, and/or eliminated. For example, the boundary layer water may be sprayed in the machine direction so that the boundary layer water does not create a high amount of drag on the stock so that build up is formed. The boundary layer shower may function to provide water that forms a boundary layer at substantially the same speed as the stock is moving. The boundary layer water may lubricate the face of the deckle board so that stock is prevented from collecting and so that thickness, caliper, density, basis weight, or a combination thereof are not affected at the dry end. The end shower, the boundary layer shower, the upper shower system, and the lower shower system all include one or more shower bars, one or more nozzles, and one or more holders.

The one or more shower bars function to provide fluid to a predetermined location. The one or more shower bars even distribute fluid across one or more and preferably a plurality of nozzles. The one or more shower bars may function to aim the spray. The one or more shower bars may function to provide fluid to a hard to reach location. The one or more shower bars may function to be movable to a desired location. The one or more shower bars may function to be static. Each of the shower systems may include one or more shower bars and preferably a plurality of shower bars. The one or more shower bars may directly receive one or more nozzles and preferably a plurality of nozzles.

The one or more nozzles may function to regulate fluid flow. The one or more nozzles may function to direct fluid to a location. The one or more nozzles may regulate the pressure of the fluid. The one or more nozzles may regulate the shape of the fluid spray. Preferably, the fluid spray is a flat fan spray. The nozzles may function to regulate the amount of fluid delivered per minute to be any of the rates listed herein for each location. Each nozzle may deliver about 0.5 L/min or more, about 1 L/min or more, about 2 L/min or more, about 3 L/min or more, or even about 5 L/min or more. Each nozzle may deliver about 50 L/min or less, about 40 L/min or less, or about 30 L/min or less. Each of the nozzles may be directed to a predetermined location by connecting the shower system into a holder.

The deckle board system may include one or more stand assemblies. The one or more stand assemblies may function to connect the deckle board, the shower systems, or both within the deckle board assembly. The stand assemblies may connect the deckle board, the shower systems, the deckle board assembly, or a combination thereof to the paper machine. The one or more stand assemblies may function to align the deckle board with the wire, forming section, paper machine, or a combination thereof. The one or more stand assemblies may include a horizontal stand, a vertical stand, or preferably both. The one or more stand assemblies may be height adjustable, horizontally adjustable, angle adjustable, or a combination thereof. Preferably, each stand assembly includes a vertical stand and a horizontal stand that are connected together.

The one or more vertical stands may connect the deckle board system to the frame of the paper machine (i.e., main frame, breast roll arm, or both). The one or more vertical stands may function to adjust the deckle board so that the deckle board, the seal strip, or both are above the wire, in contact with the wire, free of contact with the wire, at a desired location, or a combination thereof. The one or more vertical stands may function to accommodate adjustments to the foils so that a deckled edge is maintained. The one or more vertical stands may be static in the machine direction so that once the vertical stands are connected to the paper machine the vertical stands do not move relative to the paper machine. The one or more vertical stands may be rotated by the deckle boards expanding and contracting. The deckle board may be connected directly to a vertical stand. The one or more vertical stands may be connected to one or more horizontal stands.

The one or more horizontal stands may function to extend over the forming section, the wire, the foils, the wet end, or a combination thereof. The one or more horizontal stands may vary the cross-machine width of the paper machine by the length of the horizontal stand being adjusted. The one or more horizontal stands may function to change the cross-machine width of the paper machine in the machine direction as the stock flows in the machine direction. For example, a distance the horizontal stands extend over the paper machine may decrease in the machine direction as the stock flows away from the headbox so that the cross-machine length increases. The one or more horizontal stands may be adjusted so that the one or more deckle boards on a first side are straight and the one or more deckle boards on the opposing side diverge away from the deckle boards on the first side. The horizontal stands may adjust the one or more deckle boards on a first side and a second side so that both the deckle boards on the first side and the deckle boards on the second side diverge away from each other. The horizontal stands may move each of the deckle boards so that the deckle boards extend outward (i.e., increase the cross-machine width) in a linear shape, curved shape, a constant curve, an exponential curve, or a combination thereof. A segment between two of the stand assemblies may be generally linear. A segment between two stand assemblies may have a different slope as a segment between two adjacent stand assemblies (i.e., upstream or downstream in the machine direction). The horizontal stand may be moved to accommodate thermal contraction and/or thermal expansion of the deckle board.

The inner tube and outer tube may be movable relative to each other to adjust a length of the stands (e.g. height or length). The one or more outer tubes may function to allow the deckle boards to expand and contract. The one or more outer tubes may rotate. The one or more outer tubes and/or inner tubes may vertically move up and down. The one or more outer tubes and/or inner tubes may horizontally move in and out. The one or more outer tubes may be held in the system by gravity. The one or more outer tubes may rotate about an inner tube. The outer tube may have an open area that receives the inner tube. The outer tube may be hollow. The one or more outer tubes may be free of a fixed connection with the inner tube.

The inner tube may function to connect the deckle board system to the paper machine. The inner tube may function to move while the outer tube remains static. The inner tube may be static. The inner tube may form a bearing surface for the outer tube to rotate about or vice versa. The inner tube may provide a stationary part for the outer tube to be moved about. The inner tube may be solid, hollow, or a portion of both.

The lower bracket clamp and the upper bracket clamp may combine together to connect to the deckle board and prevent longitudinal movement of the deckle board. The lower bracket clamp and the upper bracket clamp may allow for rotational movement of an adjustment bracket while supporting the adjustment bracket. The lower bracket clamp and the upper bracket clamp when tightened prevent movement of the adjustment bracket and when loosened allow for movement of the adjustment bracket. The lower bracket clamp and the upper bracket clamp may be opposing arms that create a clamping force. The lower bracket clamp and the upper bracket clamp may create a clamping force by being connected by a fastener.

The adjustment bracket may function to connect a deckle board to a stand assembly (e.g., horizontal stand). The adjustment bracket may be connected to a stand assembly by a connection recess. The adjustment bracket may extend into a connection recess to connect the stand assembly to the frame. The adjustment bracket may be substantially cylindrical, flat, planar, or a combination thereof. The adjustment bracket may include one or more slots. The adjustment bracket may be free of slots. The adjustment bracket may allow the T-nut, the slidable member, or both to move with the deckle board when the deckle board expands and contracts. The adjustment bracket may connect to the deckle board and allow the deckle board to move relative to the adjustment bracket, the horizontal stand, the vertical stand, or a combination thereof. The adjustment bracket may be fixedly connected to the deckle board by one or more fasteners. The adjustment bracket may allow the deckle board to moved relative to the stand assembly.

The vertical stand, the inner tube, stand assembly, or a combination thereof may include a stand bracket, be connected to a stand bracket, or both. The vertical stand, the inner tube, the outer tube, or both may be fixedly connected to a stand bracket. The stand bracket may fit within and/or connect to a connection stand that is connected to the paper machine, a frame, or both. The stand bracket may extend over and receive the connection stand. The connection stand may receive the stand bracket. The connection stand, the stand bracket, or both may include one or more angled brackets. The stand bracket may include a plate that is connected to the inner tube, the outer tube, or both and the angled brackets may be connected to the plate. The stand bracket may be part of the stand assembly and the connection stand may be part of the frame and the stand bracket and the stand assembly when connected together may connect a stand assembly to the paper machine.

The deckle board system may be adjusted via a method. The method may include moving the vertical stands, the horizontal stands, or both so that the deckle board expands a width of the paper machine. The deckle board may be curved. The deckle board may be adjusted segment by segment. The deckle board may be added to stand assemblies that are pre-set. The deckle board stands may be moved so that the horizontal stands are out of alignment. The method may include a step of inserting a seal strip between the seal strip clamp and the deckle board clamp. A connection adapter may be inserted into a seal strip clamp recess. The connection adapter may be moved into contact with a seal strip. The connection adapter may pierce the seal strip. The connection adapter may extend into a connection slot of a seal strip. The connection adapter may include a connection member that extends into the seal strip, a connection slot of a seal strip, creates a connection slot, or a combination thereof. The connection adapter may include one or more fasteners. The one or more fasteners may extend into one or more fastener receptacles. The connection adapter may move axially along the fastener. The connection adapter may move along an axis. The connection adapter may be rotatable about the fastener. The connection adapter may be restrained from movement by a seal strip clamp recess, a bias member, a spring, a nut, a plate, a cotter pin, or a combination thereof. The connection adapter may be moved out of the seal strip clamp recess. The connection adapter may be rotated into contact with the seal strip clamp so that the seal strip may be removed. The connection adapter may be axially moved and rotated to connection to a seal strip, disconnect from the seal strip, or both. The seal strip may be removed by only removing the connection adapter. The seal strip may be removed by loosening the plurality of fasteners in contact with the one or more seal strip clamps. The seal strip may be locked in place by tightening the plurality of fasteners. The connection adapter may be moved into the seal strip by tightening a fastener, a nut, or both. The connection adapter may be moved into contact with the seal strip by a biasing member.

FIG. 1 is a perspective view of a paper machine 2. The paper machine 2 includes a wet end section 10 having a head box 4 located above a breast roll 6. The head box 4 and breast roll 6 are supported by a main frame 18 and a breast roll arm 16 respectively. The wet end section 10 includes a plurality of foil sections 12 extending in the cross-machine direction 122. A deckle board system 30 including a shower 60 with a shower bar 62 extends along the wet end 10 in the machine direction 120. The deckle board system 30 is connected to the main frame 18 by a stand bracket 94 with an angled bracket 96 and a connection stand 100.

Figure 2:
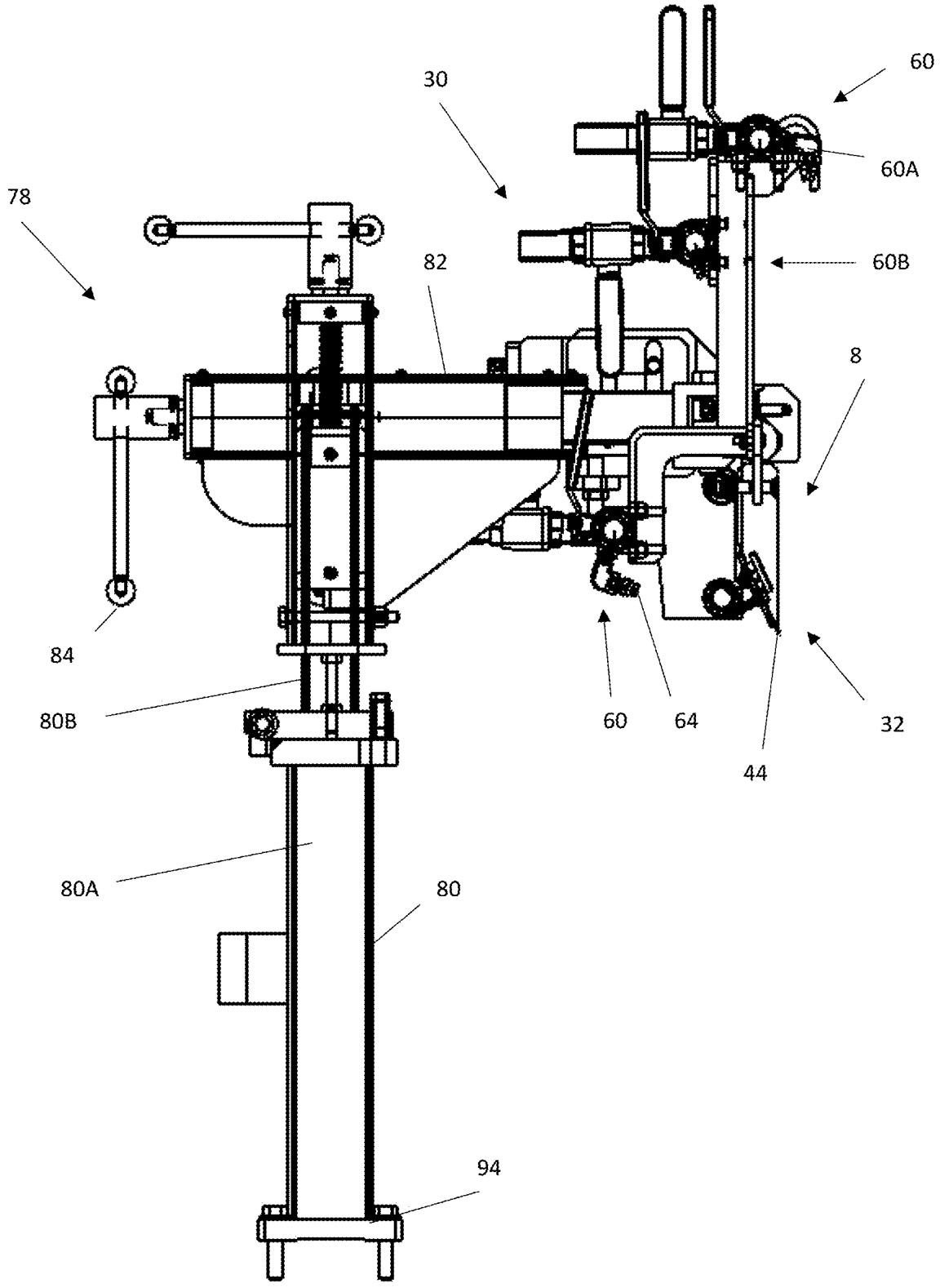
FIG. 2 is an end view of a deckle board system and stand assembly.

FIG. 2 illustrates a stand assembly 78 connected to a deckle board system 30. The stand assembly 78 includes a vertical stand 80 and a horizontal stand 82. The vertical stand 80 includes an outer tube 80A and an inner tube 80B that allows for adjustment of the vertical stand 80. A base of the vertical stand 80 includes a stand bracket 94 that connects the stand assembly 78 to a frame (not shown). The horizontal stand 82 extends from the vertical stand 80 to support the deckle board system 30. The horizontal stand 82 is adjustable by moving the adjustment device 84. The deckle board system 30 includes a shower system 60 including an upper shower system 60A and lower shower system 60B including shower nozzles 64. The shower systems 60 spray water on a stock side 8 of a deckle board 32. A seal strip 44 extends from the deckle board 32 to form an edge in the wet end of a paper machine (not shown).

Figure 3:
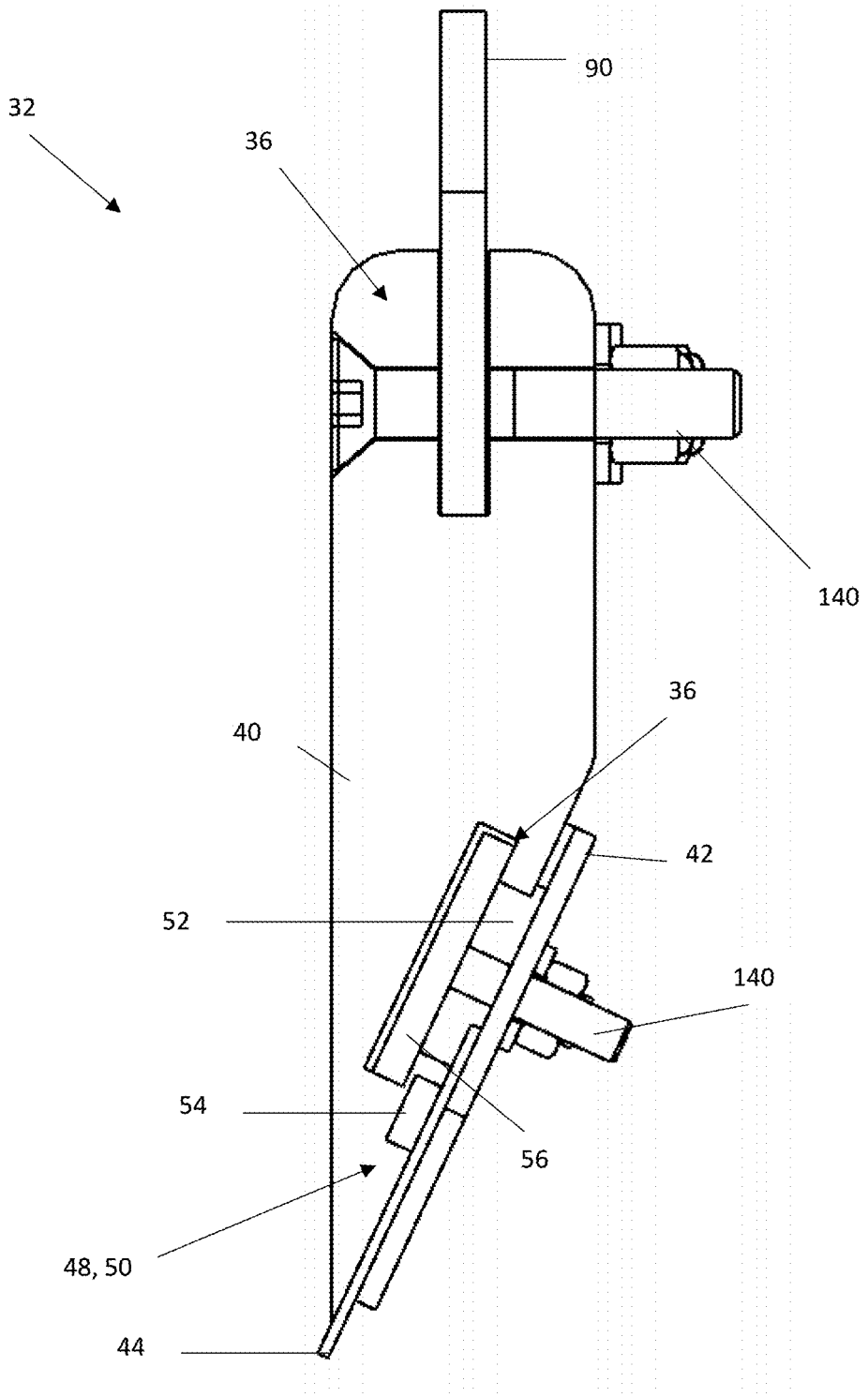
FIG. 3 is a cross-sectional view of a deckle board.

FIG. 3 is a cross-sectional view of a deckle board 32. The deckle board 32 includes a seal strip 44 located between a deckle board clamp 40 and a seal strip clamp 42 with a fastener 140 connecting the deckle board clamp 40 to the seal strip clamp 42. The deckle board clamp 40 includes a connection recess 36 that receives an adjustment bracket 90 that is connected to the deckle board clamp 40 by a fastener 140. A second fastener 140 is connected to a connector 56 located within a connection recess 36. The fastener 140 retains a connection adapter 50 in place. The connection adapter 50 includes a fastener receptacle 52 that receives the fastener 140 and a connection member 54 that extends into or creates a connection slot 48 within the seal strip 44.

Figure 4:
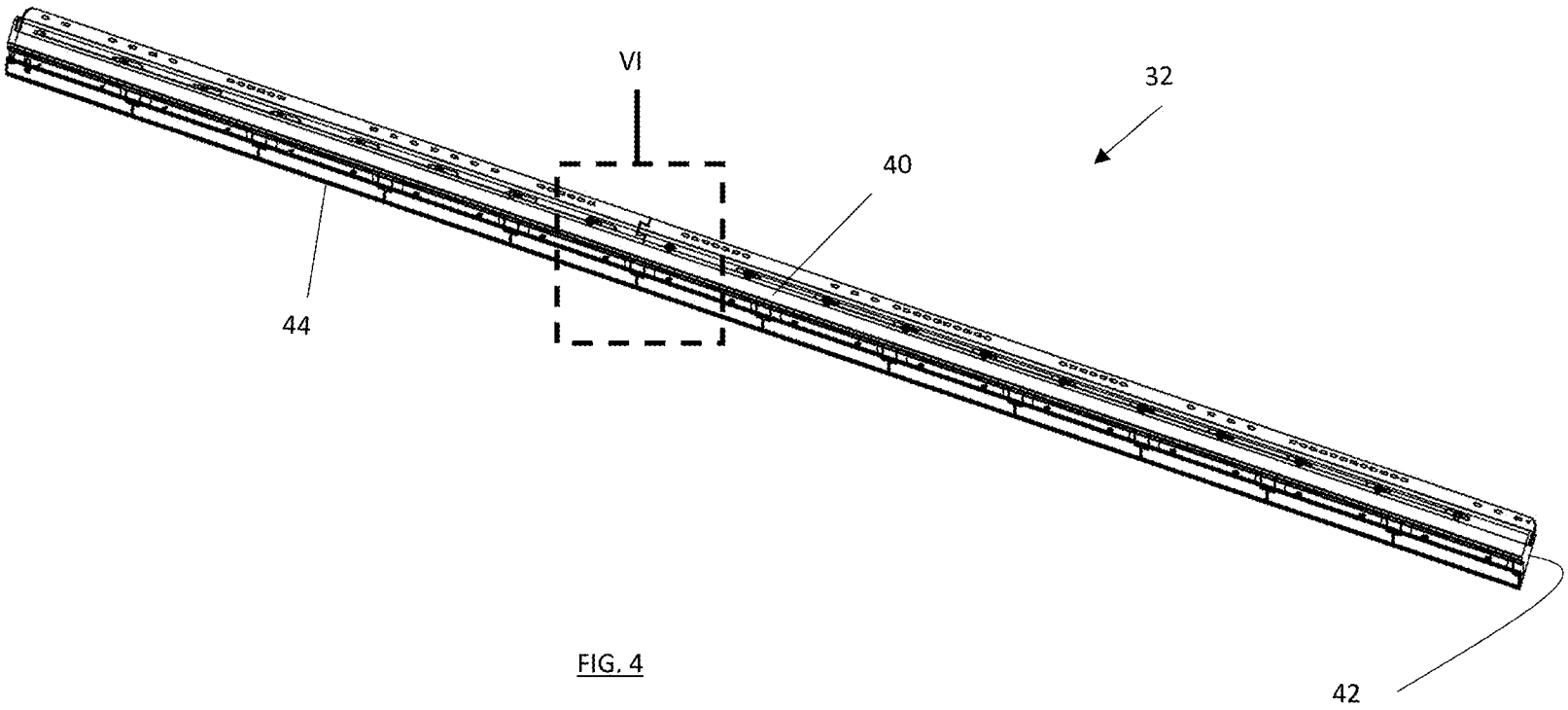
FIG. 4. Is a perspective view of a deckle board.

FIG. 4 is a cross-sectional view of a deckle board 32 including a deckle board clamp 40 and a seal strip clamp 42 that retain a seal strip 44 in place.

Figure 5A:
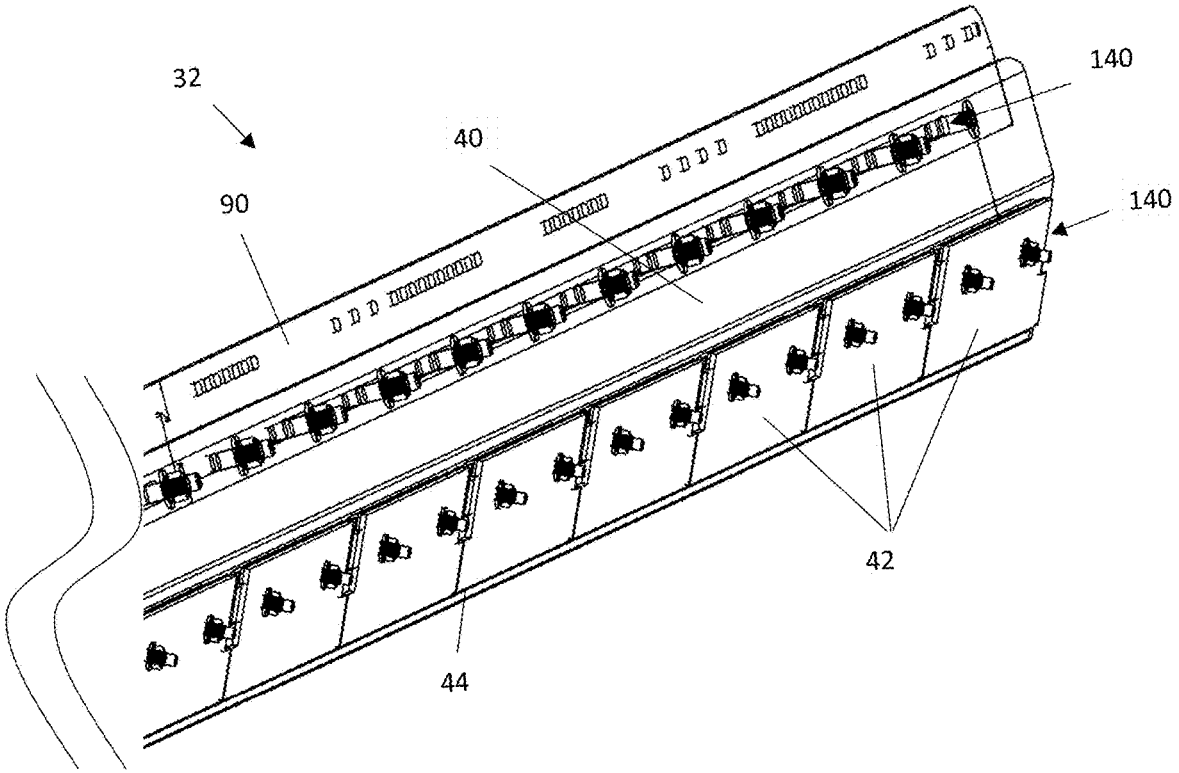
FIG. 5A is a rear perspective view of deckle board.

FIG. 5A is a portion of a section of a deckle board 32. The deckle board 32 includes a deckle board clamp 40 and a plurality of seal strip clamps 42 that retain a seal strip 44 in place by being connected together by a plurality of fasteners 140. The deckle board clamp 40 is connected to an adjustment bracket 90 via a plurality of fasteners 140.

Figure 5B:
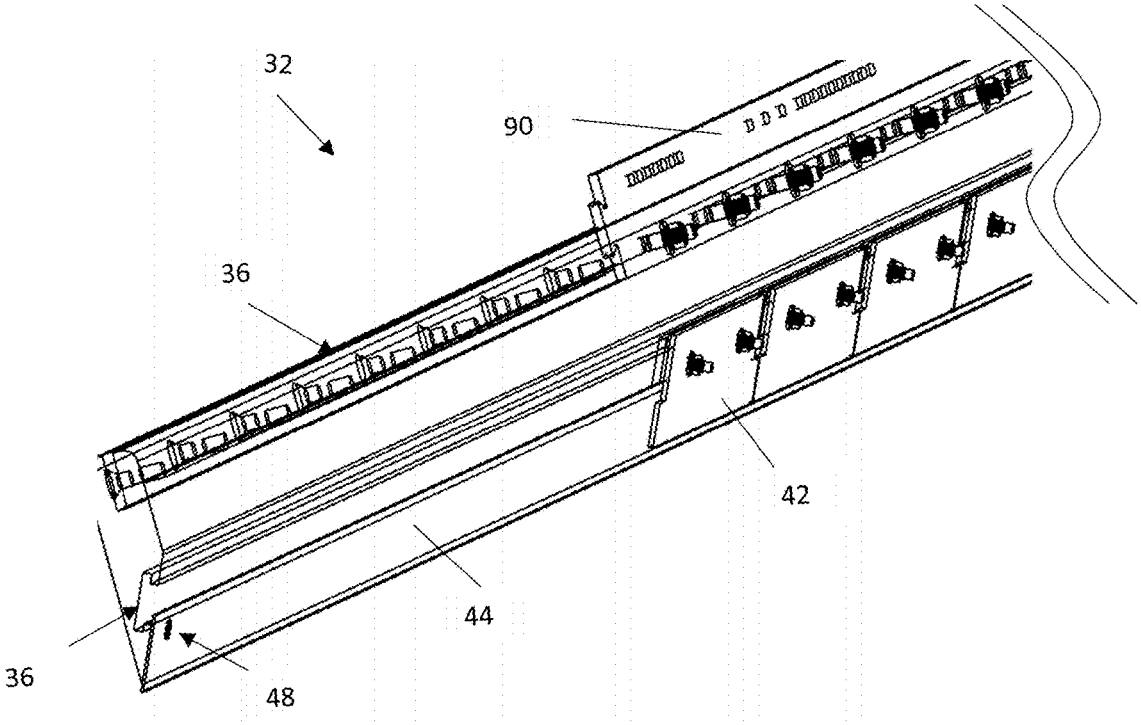
FIG. 5B is a rear perspective view of a deckle board that is partially disassembled.

FIG. 5B illustrates a cross-sectional view of a deckle board 32. Some of the plurality of seal strip clamps 42 have been removed exposing the seal strip 44, connection slot 48, and connection recess 36. A portion of the adjustment bracket 90 has been removed exposing a second connection recess 36 in the deckle board clamp 40.

Figure 6:
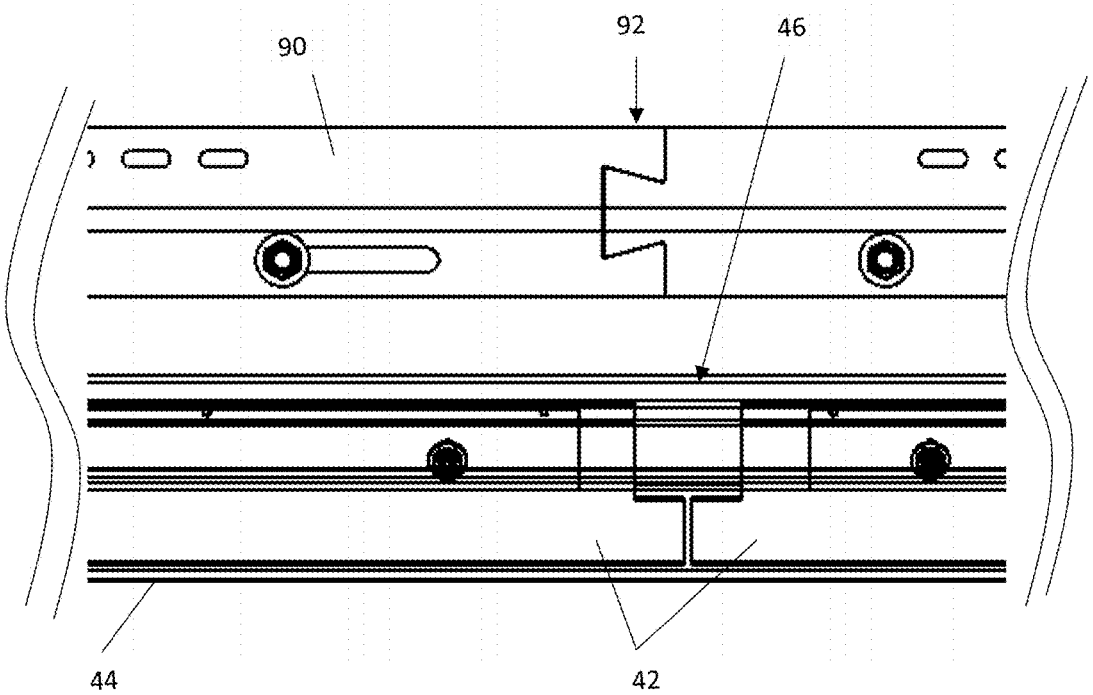
FIG. 6 is a plan view of a connection joint.

FIG. 6 is a close-up view of the connection joint 92 in the adjustment bracket 90 of FIG. 4. The connection joint 92 as shown is aligned with an expansion chamber 46 located between two adjacent seal strip clamps 42. A seal strip 44 extends below the seal strip clamps 42.

Figure 7:
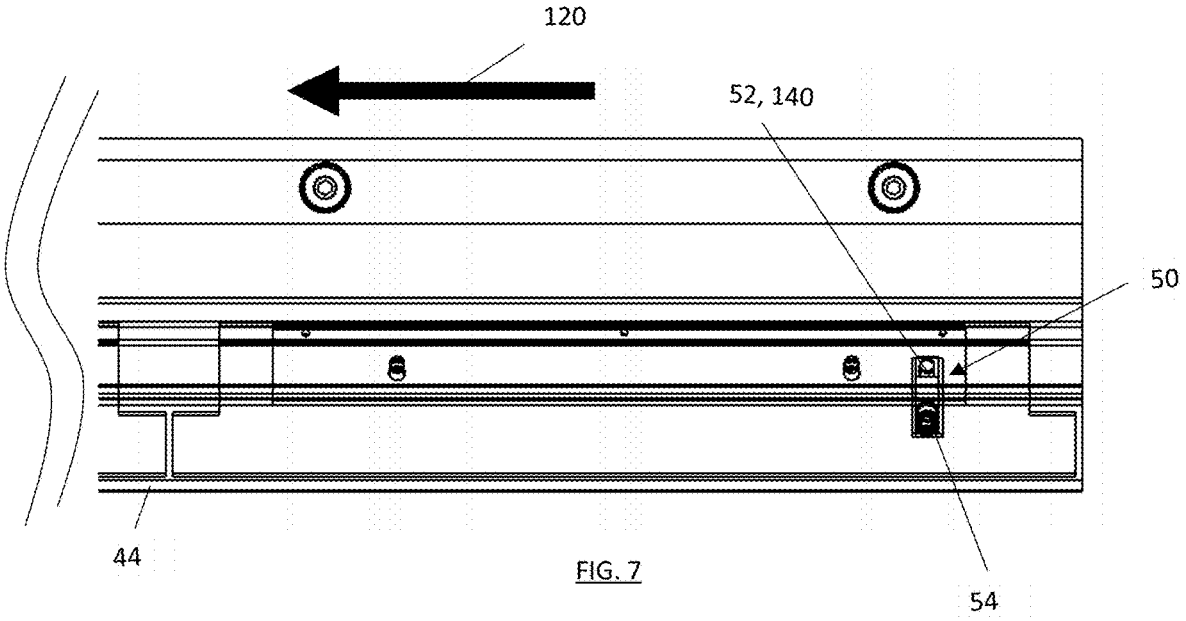
FIG. 7 is a plan view of a deckle board including a connection adapter.

FIG. 7 illustrates the connection adapter 50 having a fastener receptacle 52 that receives a fastener 140. The connection adapter 50 also includes a connection member 54 that connects the seal strip 44 and prevents the seal strip from being moved in the machine direction 120.

Figure 8:
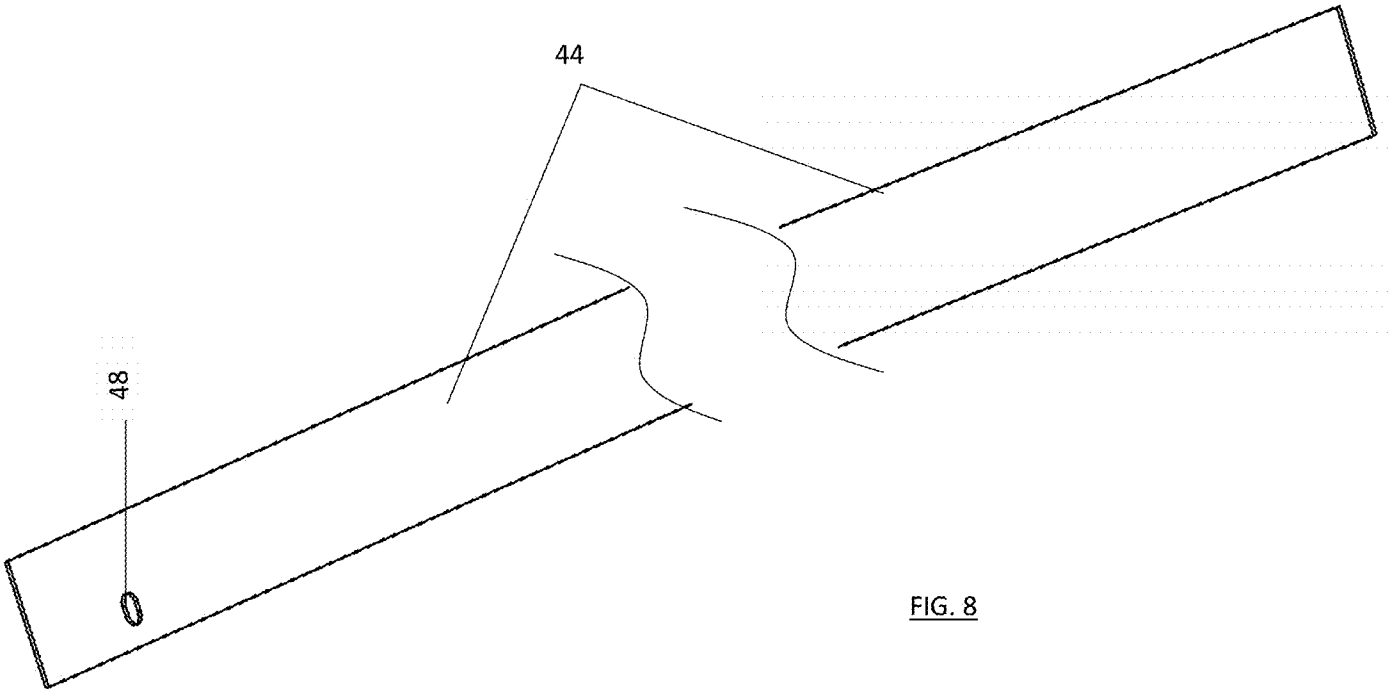
FIG. 8 is a perspective view of a seal strip including a single slot.

FIG. 8 is a perspective view of a seal strip 44 including one preformed connection slot 48.

Figure 9:
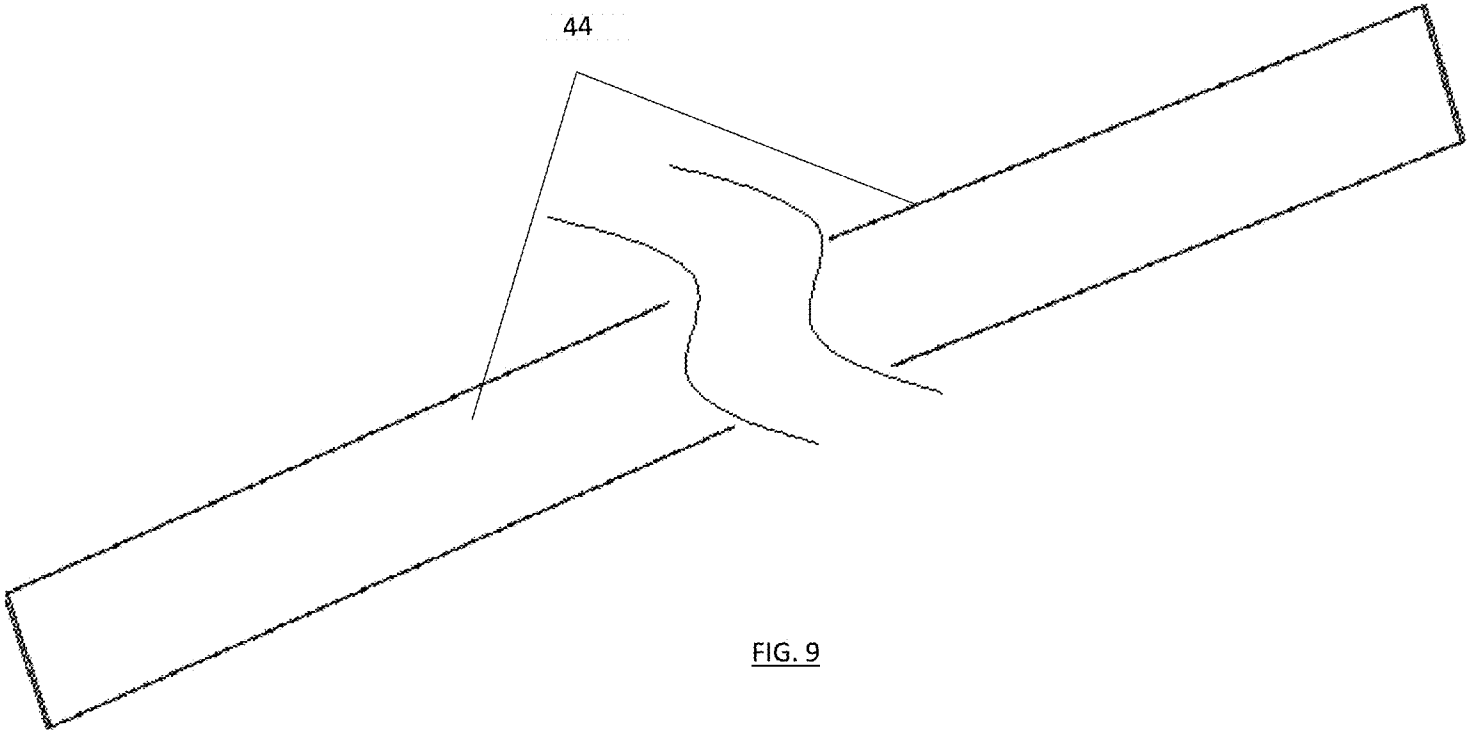
FIG. 9 is a perspective view of a seal strip that is slotless.

FIG. 9 is a perspective view of a seal strip 44 that is free of any connection slots.

Figure 10:
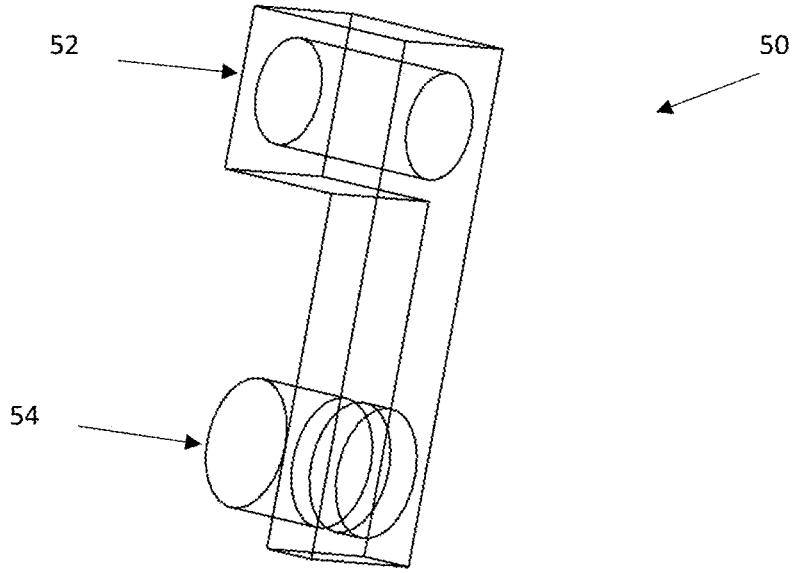
FIG. 10 is a perspective view of a connection adapter.

FIG. 10 is a perspective view of a connection adapter 50 including a fastener receptacle 52 and a connection member 54.

Figure 11:
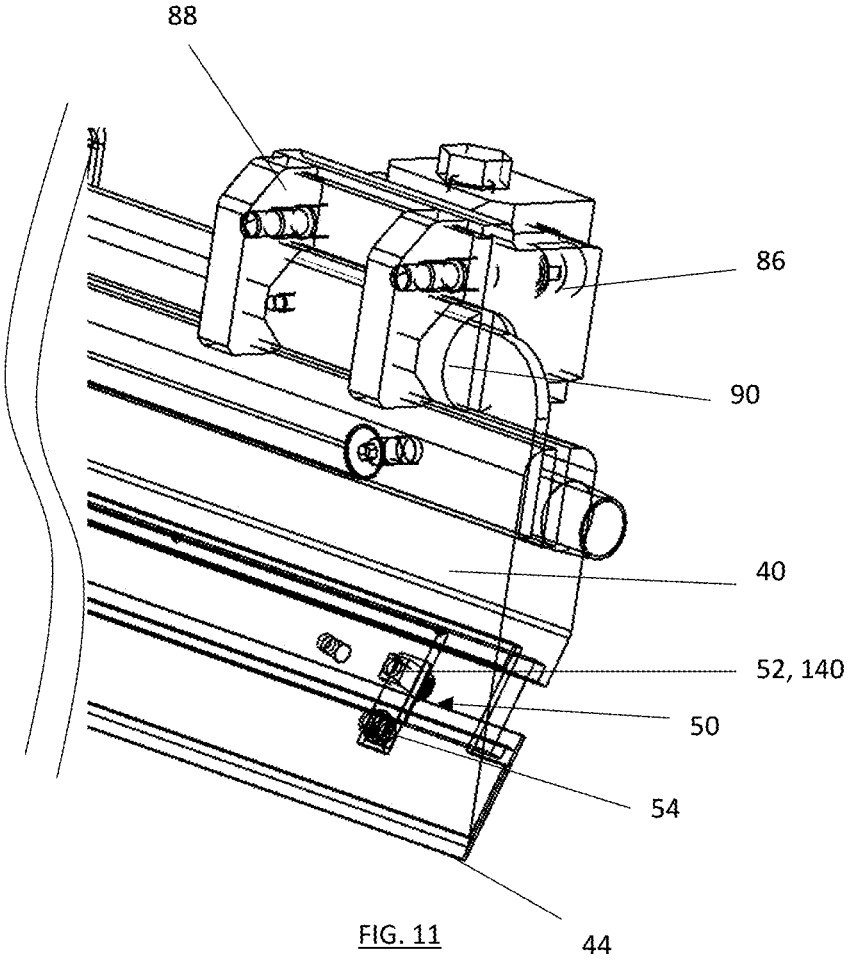
FIG. 11 is a close-up perspective view of a connection adapter connecting a seal strip to a deckle board.

FIG. 11 is a perspective view of a connection adapter 50 located within a deckle board clamp 40. The connection adapter 50 includes a fastener receptacle 52 that receives a fastener 140 to connect the connection adapter 50 to the deckle board clamp, and a connection member 54 that connections to a seal strip 44. An adjustment bracket 90 is connected to the deckle board clamp 40. The adjustment bracket 90 includes a lower bracket clamp 86 and an upper bracket clamp 88 that allow for adjustment of the deckle board.

Figure 12:
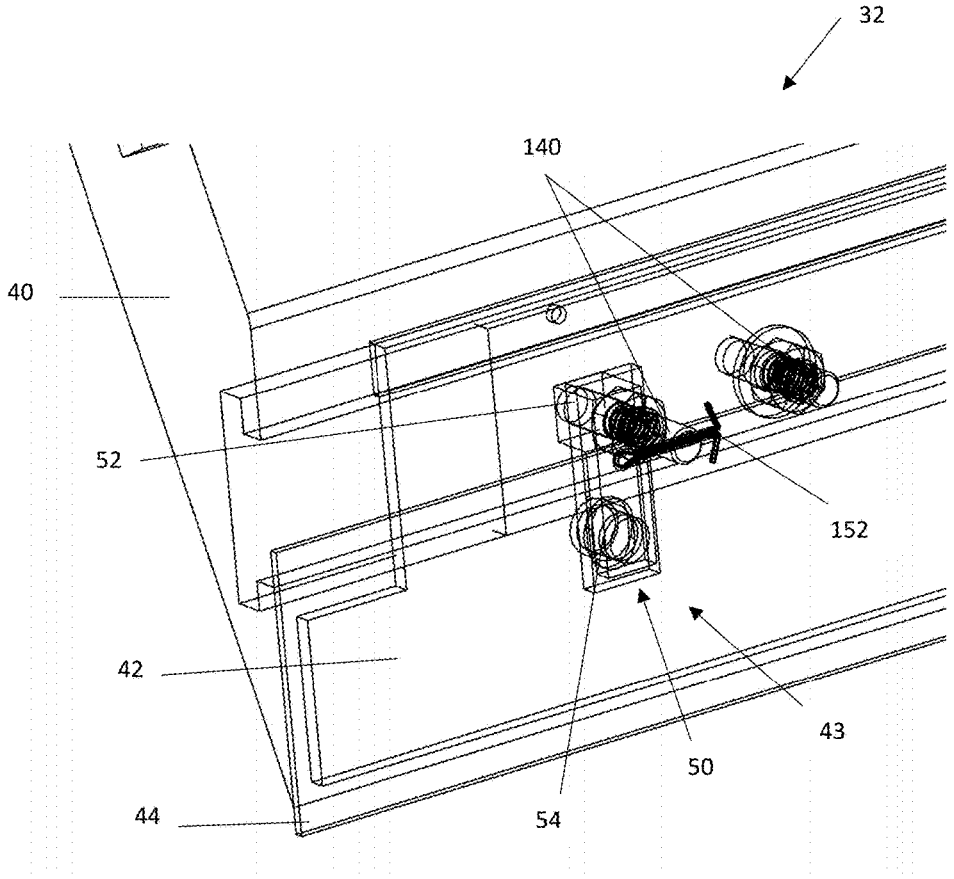
FIG. 12 is a rear view of a connection adapter extending into a seal strip clamp recess.

FIG. 12 is a perspective view of a rear side of a deckle board 32. The deckle board 32 includes a seal strip 44 located between a deckle board clamp 40 and a seal strip clamp 42, which are connected together by a fastener 140. The seal strip clamp 42 includes a seal strip clamp recess 43 that receives a connection adapter 50. The connection adapter 50 includes a fastener receptacle 52 that extends through the connection adapter 50 so that a fastener 140 can extend therethrough and form a connection with the deckle board clamp 40. The fastener 140 includes a retainer 152 that prevents the connection adapter 50 from being removed axially along the fastener 140. The connection adapter 50 also includes a connection member 54 that contacts the seal strip 44 and forms a connection with the seal strip 44 to prevent the seal strip from moving in the machine direction.

Figure 13:
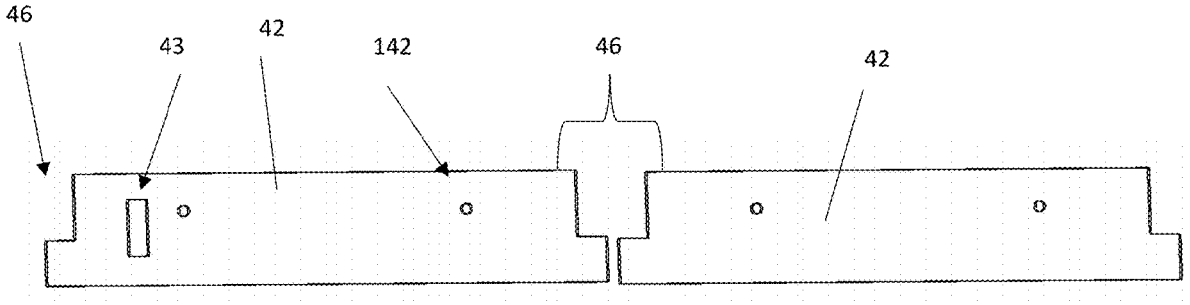
FIG. 13 is a plan view of two adjacent seal strip clamps with one seal strip clamp including a seal strip clamp recess.

FIG. 13 is a plan view of two adjacent seal strip clamps 42. The seal strip clamps 42 are separated by an expansion chamber 46. Each of the seal strip clamps 42 include a fastener recess 142. As shown, one of the seal strip clamps 42 includes a seal strip clamp recess 43 that receives a connection adapter (not shown). All of the seal strip clamps 42 may include a seal strip clamp recess 43 however, only one may include a connection adapter (now shown).

Figure 14A:
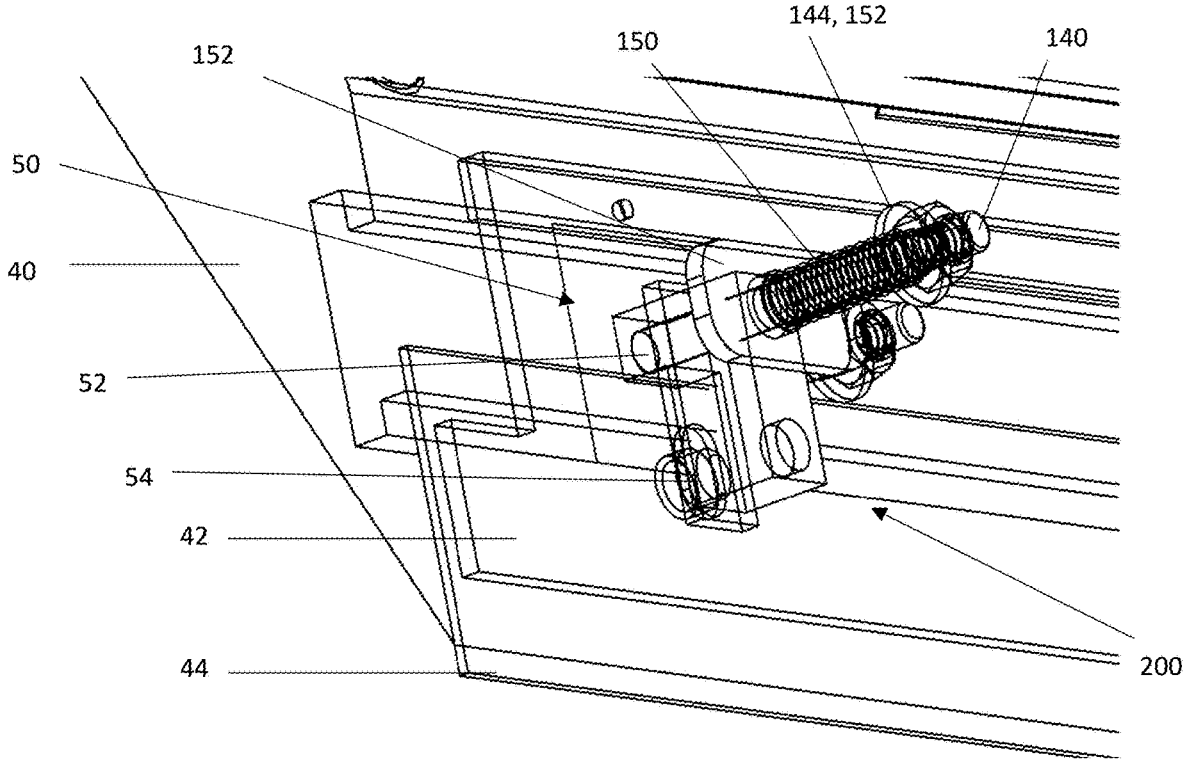
FIG. 14A is a perspective view of the connection adapter in the locked position.

FIG. 14A Illustrates the connection adapter 50 in a locked position 200. The connection adapter 50 has a fastener receptacle 52 that receives a fastener 140, which extends into and connects the connection adapter 50 to a deckle board clamp 40. The fastener 140 includes two retainers 152 with a bias member 150 therebetween. One of the fasteners 140 is shown as a nut 144. The connection adapter 50 is movable along the fastener 140 compressing the bias member 150 so that the seal strip 44 is removable from between the deckle board clamp 40 and the seal strip clamp 42 by the connection member 54 releasing the seal strip 44.

Figure 14B:
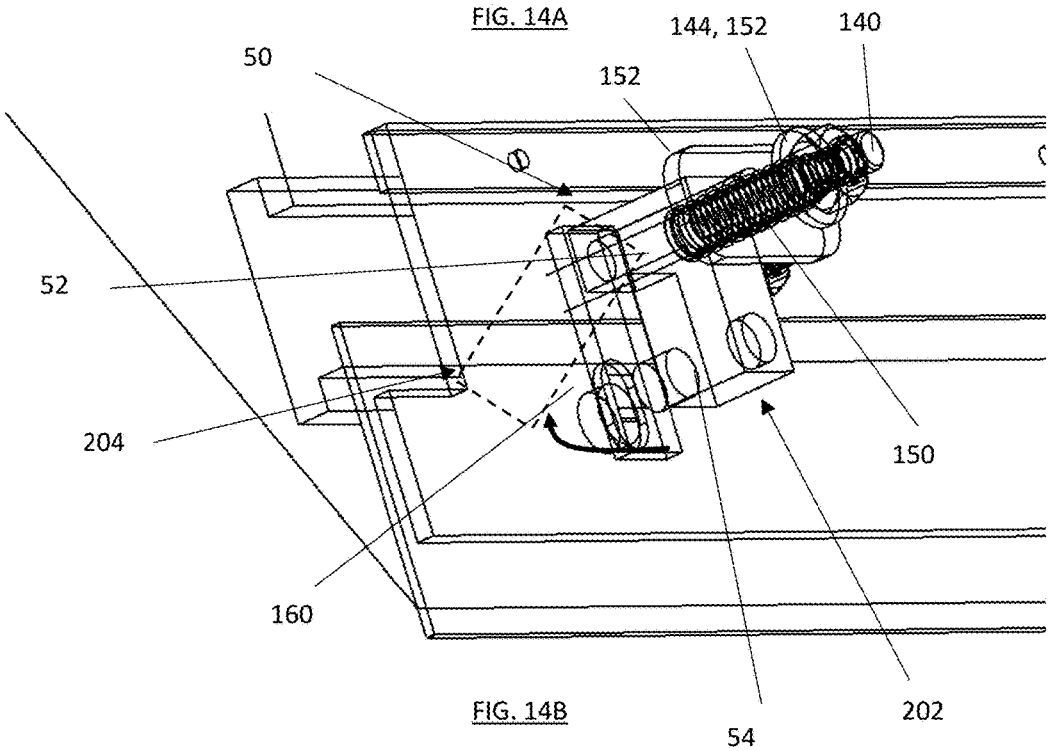
FIG. 14B is a perspective view of the connection adapter moving from the retracted position to the rotated position.

FIG. 14B illustrates the connection adapter 50 moving between a retracted position 202 and a rotated position 204 by rotating in the direction 160. The connection adapter 50 in the retracted position 202 axially moves along the fastener 140 compressing the bias member 150 between the retainers 152, one of which is a nut 144. The fastener 140 extends through a fastener receptacle 52 in the connection adapter 50 and the connection adapter is rotatable about the fastener 140 over the seal strip clamp 42, where the connection adapter 50 may be locked in a rotated position 204 while the seal strip 44 is changed.

Any numerical values recited herein include all values from the lower value to the upper value in increments of one unit provided that there is a separation of at least 2 units between any lower value and any higher value. As an example, if it is stated that the amount of a component or a value of a process variable such as, for example, temperature, pressure, time and the like is, for example, from 1 to 90, preferably from 20 to 80, more preferably from 30 to 70, it is intended that values such as 15 to 85, 22 to 68, 43 to 51, 30 to 32 etc. are expressly enumerated in this specification. For values which are less than one, one unit is considered to be 0.0001, 0.001, 0.01 or 0.1 as appropriate. These are only examples of what is specifically intended and all possible combinations of numerical values between the lowest value and the highest value enumerated are to be considered to be expressly stated in this application in a similar manner.

Unless otherwise stated, all ranges include both endpoints and all numbers between the endpoints. The use of "about" or "approximately" in connection with a range applies to both ends of the range. Thus, "about 20 to 30" is intended to cover "about 20 to about 30", inclusive of at least the specified endpoints.

The disclosures of all articles and references, including patent applications and publications, are incorporated by reference for all purposes. The term "consisting essentially of" to describe a combination shall include the elements, ingredients, components or steps identified, and such other elements ingredients, components or steps that do not materially affect the basic and novel characteristics of the combination. The use of the terms "comprising" or "including" to describe combinations of elements, ingredients, components or steps herein also contemplates embodiments that consist essentially of or even consists of the elements, ingredients, components or steps.

Plural elements, ingredients, components or steps can be provided by a single integrated element, ingredient, component or step. Alternatively, a single integrated element, ingredient, component or step might be divided into separate plural elements, ingredients, components or steps. The disclosure of "a" or "one" to describe an element, ingredient, component or step is not intended to foreclose additional elements, ingredients, components or steps.

It is understood that the above description is intended to be illustrative and not restrictive. Many embodiments as well as many applications besides the examples provided will be apparent to those of skill in the art upon reading the above description. The scope of the invention should, therefore, be determined not with reference to the above description, but should instead be determined with reference to the appended claims, along with the full scope of equivalents to which such claims are entitled. The disclosures of all articles and references, including patent applications and publications, are incorporated by reference for all purposes. The omission in the following claims of any aspect of subject matter that is disclosed herein is not a disclaimer of such subject matter, nor should it be regarded that the inventors did not consider such subject matter to be part of the disclosed inventive subject matter.

2 Paper machine
4 Head box
6 Breast Roll
8 Stock side
10 Wet end
12 Foil sections
16 Breast Roll Arm
18 Main frame
30 Deckle board system
32 Deckle board
36 Connection recess
40 Deckle board clamp
42 Seal strip clamp
43 Seal strip clamp recess
44 Seal strip
46 Expansion chamber
48 Connection slot
50 Connection Adapter
52 Fastener receptacle
54 Connection member
56 Connector
60 Shower system
60A Upper Shower System
60B Lower Shower System
62 Shower bar
64 Shower nozzles
78 Stand Assembly
80 Vertical stand
80A Outer tube
80B Inner Tube
82 Horizontal stand
84 Adjustment device
86 Lower Bracket Clamp
88 Upper Bracket Clamp
90 Adjustment Bracket
92 Connection joint
94 Stand bracket
96 Angled bracket
100 Connection stand
120 Machine direction
122 Cross machine direction
140 Fasteners
142 fastener recess
144 Nut
150 Bias member
152 Retainer
160 Rotation
200 Locked position
202 Retracted position
204 Rotated position

We claim:

1. A system comprising:
one or more deckle board systems, each of the deckle board systems including:
a. one or more deckle board clamps;
b. one or more seal strip clamps; and
c. one or more seal strips;
wherein each of the seal strips include one connection slot or less; and
wherein one or more connection adapters are connected to one of the one or more deckle board clamps and one of the one or more seal strips, and the one or more connection adapters include one or more connection members.

2. The system of claim 1, wherein the each of the seal strips are free of the one connection slot.

3. The system of claim 1, wherein the one or more deckle board systems are two deckle board systems and each deckle system includes on one of the one or more seal strips.

4. The system of claim 1, wherein the one or more seal strip clamps include a seal strip clamp recess.

5. The system of claim 4, wherein the seal strip clamp recess exposes a portion of one of the one or more seal strips, a portion of the one of the one or more deckle board clamps, a connection recess within the one or more deckle board clamps, one or more fastener recesses within the one or more seal strip clamps, or a combination thereof.

6. A system comprising:
one or more deckle board systems, each of the deckle board systems including:
a. one or more deckle board clamps;
b. one or more seal strip clamps; and
c. one or more seal strips;
wherein each of the seal strips include one connection slot or less; and
wherein the one or more seal strip clamps include one or more expansion chambers.

7. The system of claim 6, wherein one or more connection adapters are connected to one of the one or more deckle board clamps and one of the one or more seal strips.

8. The system of claim 7, wherein the one or more connection adapters include one or more fastener receptacles.

9. The system of claim 8, wherein the one or more fastener receptacles are a through hole that a fastener extends through to connect the one or more connection adapters to the one of the one or more deckle board clamps.

10. The system of claim 8, wherein the one or more connection adapters are axially movable along the one or more fastener receptacles.

11. The system of claim 9, wherein a bias member is located along the fastener so that the one or more connection adapters are biased from a retracted position to a locked position.

12. The system of claim 7, wherein the one or more connection adapters include one or more connection members.

13. The system of claim 12, wherein the one or more connection members of the connection adapter extends into the one connection slot in the seal strip.

14. The system of claim 13, wherein the one or more connection members have a blunt end.

15. The system of claim 12, wherein the seal strip is free of any connection slots and the one or more connection members pierce the seal strip to form a connection slot or deform the seal strip to prevent movement of the seal strip in a machine direction of a paper machine.

16. The system of claim 12, wherein the one or more connection members have a point, are sharpened, have a tip, have a partial diamond shape, are cone shaped, or a combination thereof.

17. The system of claim 11, wherein the bias member is in contact with one or more retainers.

18. The system of claim 8, wherein the one or more connection adapters are rotatable about an axis.

19. The system of claim 9, wherein the one or more connection adapters are rotatable about the fastener.

20. The system of claim 6, wherein the one or more seal strip clamps are a plurality of seal strip clamps and each of the plurality of seal strip clamps are cut out on an edge of each of the plurality of seal strip clamps.

* * * * *